US005895009A

United States Patent [19]

Sato et al.

[11] Patent Number: 5,895,009

[45] **Date of Patent: *Apr. 20, 1999**

[54] TRANSFER METHOD OF COILS AND COIL TAKING-UP AND STACKING EQUIPMENT

[75] Inventors: Masashi Sato; Shinji Hasumi; Keiichi Muraoka, all of Kanagawa-ken; Sinji Nishino, Tokyo, all of Japan

[73] Assignee: Nippon Mining and Metals Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/616,795

[22] Filed: Mar. 15, 1996

[30] Foreign Application Priority Data

May 17, 1995 [JP] Japan ..... 7-118761
Jun. 23, 1995 [JP] Japan ..... 7-157361

[51] Int. Cl.[6] ..... B65H 19/18; B65H 18/28; B21D 39/03

[52] U.S. Cl. ..... 242/556; 242/559.3; 242/160.2; 242/167; 156/158; 29/429

[58] Field of Search ..... 242/556, 559, 242/559.3, 160.2, 167; 156/158; 29/429; 226/199, 176

[56] References Cited

U.S. PATENT DOCUMENTS 3,084,425 4/1963 Erskine ..... 242/556 X
3,233,526 2/1966 Sherman ..... 242/556
3,802,061 4/1974 Teague et al. ..... 228/199 X
4,022,396 5/1977 Manchester et al. ..... 242/160.2
4,332,357 6/1982 Armstrong ..... 242/556 X
5,289,985 3/1994 Cocchi et al. ..... 242/559

FOREIGN PATENT DOCUMENTS 404101952 4/1992 Japan ..... 242/556

*Primary Examiner*—John Q. Nguyen
*Attorney, Agent, or Firm*—Panitch Schwarze Jacobs & Nadel, P.C.

[57] ABSTRACT

A method of joining a plurality of coils of strip material into a continuous strip and stacking the coils in a multi-coil arrangement is provided. A first coil is conveyed from a carry-in table by a transfer means to an exit side turn table and is designated as a forward coil. A first strip of material is pulled from the forward coil and supplied to a welding machine through an auxiliary guide roll and an exit side guide roll. A second coil is conveyed to an entry side turn table by the transfer means and designated as the rear coil. A second strip of material is pulled from the rear coil and supplied to the welding machine through an entry side guide roll. The first and second strips of material are welded together into a continuous strip of material. The rear coil is then moved to a stand-by position and sag is removed from the continuous strip of material by synchronously rotating the entry side guide roll, the exit side guide roll, the auxiliary guide roll and the exit side turn table. The rear coil is conveyed toward the exit side turn table while simultaneously taking up and recoiling sag in the continuous strip of material between the rear coil and the forward coil into the forward coil during said conveying, to allow the rear coil to be stacked over forward coil.

6 Claims, 18 Drawing Sheets

TRANSFER METHOD OF COILS AND COIL TAKING-UP AND STACKING EQUIPMENT

BACKGROUND OF THE INVENTION

The present invention pertains to a processing of a plurality of coils each formed by winding a belt-like metallic strip, and particularly relates to a method of transferring coils, in which the coils are placed at both the exit side and the entry side of a welding machine through a coil transfer line made by combining transfer means with various equipment including the welding machine, resulting in positioning the forward coil and the rear coil, and after placing both coils in a continuous state by welding them with the welding machine, the rear coil is transferred while the forward coil is being taken up and the sag in the strip is absorbed, and then the rear coil is stacked on the forward coil. The present invention also relates to equipment which has coils each made by winding a belt-like metallic strip welded together thus forming them into a continuous coil, then to transfer the rear position coil as viewed in the coil transfer direction while taking up the coil at the forward position, then the rear coil is stacked on the forward coil.

The metallic strip is in general processed into a form having desired properties and thickness by repeated rolling and heat treatment on an ingot and finally it is slit into a desired width by a slitter, wherein the width direction of the strip is made parallel with the central axis of the coil, and at the same time formed into a coil of the strips being taken up with slit edges being put in line. And such a coil is to have various fabrication processes made thereon as it is used as a metallic raw material. For example, a process of welding the strips of a plurality of coils together is to make coils into a continuous form.

Now, this type of coil is of a large size, that is, for example the minimum diameter of 600 mm and the maximum diameter of 1,000 mm, and further, they have an appreciable weight, such as 100 to 300 kg for a coil of copper alloy. Therefore, considerable difficulties are encountered in handling and processing coils, for example when the coils are formed into a continuous form as mentioned.

There will be a number of problems that must be solved, for example, when any desired length of each strip is taken out of two coils for welding each end of the strip, how should it be fed into a welding machine? Also, When a strip having some length is taken out respectively of the two coils for welding, what action is taken to correct the twisting or sag, etc. in the strip into a proper form before and after the welding? How the strip connected into a continuous form after the welding is taken up? And how the load of taking up derived from the weight of the strip and the twisting and sag of the strip are taken care of? Further, what should be done for properly taking care of the consecutive processing of connecting a plurality of coils into a continuous form one by one and then stacking the same?

But, as far as the applicants could detect, to their regret, there is no method of stacking a plurality of coils, nor equipment for taking up and stacking the coils which are known to have solved such various problems.

Therefore, an object of the present invention is to provide a consolidated transferring method with a premise of welding a plurality of coils into a continuous form.

Another object of the present invention relates to a plurality of coils each formed by winding a metallic strip and lies in providing such a coil transfer method that coils are transferred by a coil transfer line in which a transfer means is combined with various kinds of equipment including a welding machine, and after the process of forming the coils into a continuous shape with the welding machine, the coil at the rear position as viewed in the coil transfer direction is transferred while the coil at the forward position is taken up, absorbing the sag in the strip, and the coil from the rear position is stacked on the coil in the forward position.

Still another object of the present invention is to provide such a coil transfer method that a plurality of large and heavy coils are conveyed by a transfer equipment, and strips supplied to a welding machine are welded one by one, then the strip and the sag in the strip is taken up and absorbed by a rotation of the coil at the forward position without scratching the strip, and the coil in the rear position is stacked over the coil in the forward position on an exit side turn table thus forming a plurality of coils which have been made into a continuous shape, then the coils can be taken out finally from the transfer line as one consolidated product, thus such a continuous transfer process as suited to the properties of the coil and the strip can be achieved.

Further, another object of the present invention is to provide such coil taking up and stacking equipment so that coils of metallic strips which have been welded and formed into a continuous shape are so processed as taking up one of the coils while transferring the other coil, with due care being paid to the properties of the coil and the strip, and one of the coil is stacked on the other coil.

Still another object of the present invention is to provide such coil taking up and stacking equipment so that the coil at the forward position, out of two coils which are in forward and rear positions respectively in a coil transfer direction and at the same time are connected to each other by welding, is rotated in a horizontal state on a turn table device, also the coil in the rear position is held and transferred in a horizontal state by a transfer equipment, then the strip is taken up by the coil at the forward position and the coil in the rear position is stacked on the coil at the forward position.

Further, another object of the present invention is to provide such coil taking up and stacking equipment that when coils are welded one by one to form them into a continuous coil and are taken up and stacked, two coils in the front and rear positions are dividedly supported by a transfer equipment and a turn table device, where the turn table device can take up the strip with edges of the strip aligned well and even when the coil has a tilt or warp, etc. generated therein, a position being safe relative to the coil can be taken by a follow-up function, thus avoiding a damage on a guide roll device for guiding the take up.

SUMMARY OF THE INVENTION

In summarizing, the coil transfer method of the present invention is to make each one of the following processes:

Supply of coils

A process of placing a plurality of coils each one of which is independent in a stacked state on their sides and carrying them onto a carry-in table, and conveying a first coil on the carry-in table to an exit side turn table by transfer means, then pulling out a strip of the coil supplied to the exit side turn table, which is designated as the forward coil, thus supplying the strip to a welding machine through an auxiliary guide roll and an exit side guide roll, and a process of supplying a second coil on the carry-in table to an entry side turn table with a transfer means and pulling out a strip of this coil, which is designated as the rear coil, thus supplying the strip to the welding machine through an entry side guide roll, Absorbing a sag in the strip A process of welding the ends of two strips of the forward and rear coils, forming these forward and rear coils in a continuous shape, then taking out the rear coil on the entry side turn table by the transfer means and placing it in a stand-by posture, then synchronizedly rotating the entry side guide roll, the exit side guide roll, the auxiliary guide roll, the exit side turn table, etc. for consecutively taking up and absorbing the sag in the strip between the entry side turn table and the entry side guide roll and then the sag in the strip between the entry side guide roll and the exit side guide roll by the forward coil, and Transfer and stacking of the rear coil:

A process of taking up and absorbing a sag in the strip with the forward coil while making the rear coil placed in the taken out and stand-by posture conveyed to and approached to the exit side turn table with the transfer means, and retracting the entry side guide roll, the exit side guide roll, the auxiliary guide roll, etc. in turn from the transfer line in correspondence with the approach of the transfer means, then stopping the transfer means at an upper position corresponding to the exit side turn table, and supplying and stacking the rear coil over the forward coil.

First, a plurality of coils each one of which is independent, are carried in to a carry-in table in a stacked posture on their sides by a suitable means for example a forklift, etc., and transfer means is moved to an upper position corresponding to the carry-in table, and after taking up one coil in the first position (a coil in the uppermost position) on the carry-in table by suction means, the transfer line is moved to the direction of the exit side so that the coil is conveyed to the exit side turn table.

Next, on the one hand, the coil unloaded on (supplied to) the exit side turn table is designated as the "forward coil", and a strip of this forward coil is pulled out by an operator and placed in such a state as to pass through the auxiliary guide roll and the exit side guide roll and is supplied to a welding machine. And on the other hand, a second coil on the carry-in table is taken up by returning the previously mentioned transfer means, and is supplied to an inverting table for inverting the same as required.

This inverting process is made when it is necessary to change the winding direction of a coil. After being inverted, or without being inverted if the inversion is not necessary, the second coil which has been taken up is conveyed and supplied to the entry side turn table and is designated as the "rear coil", and a strip of this rear coil is similarly pulled out by an operator and is supplied to the welding machine through the entry side guide roll.

Lengths of strips of both of the forward and rear coils are taken out as much as necessary and are placed in such a state as to have been supplied to the welding machine as mentioned above. In such a state, the strip of the forward coil is guided with the auxiliary guide roll and the exit side guide roll while the strip of the rear coil is guided by the entry side guide roll, respectively, thus restraining the twisting of the strip and a retention of proper strip shape are effected, further, the load of weight of the taken out strip will not inflict unnecessary influence over both of the forward and rear coils. Similar actions are made when the strips are handled and further taken out at the time of welding, thus the guided state of the strips will be maintained.

With the above mentioned taking out of the strips and their supply to the welding machine, a preparation for a welding process could be regarded as completed. Then both ends of the strips are welded together with the welding machine and both of the forward and rear coils are formed into a continuous state.

When the welding is completed, the rear coil is taken out from the entry side turn table by the transfer means again and is conveyed to the exit side direction and is finally stacked over the forward coil on the exit side turn table, and in this case it will be necessary to prevent the strips, which have been taken out respectively from both of the forward and rear coils and formed into a continuous shape by welding, from contacting various equipment and being scratched and/or damaged. Therefore, the welding machine is first made to retreat from the transfer line after the welding.

And, a process of absorbing the sag in the strip is made in such a state that the rear coil on the entry side turn table is taken out by the transfer means and is held in a stand-by posture. For that end, the entry side guide roll, the exit side guide roll, the auxiliary guide roll, the exit side turn table, etc. are synchronizedly rotated for taking up and absorbing a sag in the strip between the entry side turn table and the entry side guide roll then another sag in the strip between the entry side guide roll and the exit side guide roll in turn with the forward coil.

Further, while the rear coil which has been taken out and placed in a stand-by posture is conveyed to the exit side turntable by the transfer means, taking up and absorbing the sag in the strip by the forward coil, the entry side guide roll, the exit side guide roll, the auxiliary guide roll, etc. which would interfere with the strip are made to retreat from the transfer line in turn in correspondence with an approach of the transfer means. Finally, the strip remaining between the forward and rear coils will become extremely short and the transfer means is made to stop at an upper position corresponding to the exit side turn table and the rear coil is supplied and stacked over the forward coil, thus completing the transfer of the coils.

The transfer of the coils for welding the coils is done in a continuous manner by repeating the above mentioned processes continuously. In this continuous coil transfer, if the next coil on the carry-in table is conveyed and supplied by the transfer means onto the entry side turn table beforehand, and is placed in a stand-by posture there. This may shorten the overall process time and is desirable in effecting the continuous processing.

After returning various kinds of equipment which have been retracted from the transfer line, to their former positions, the above processes are repeated continuously and a plurality of coils, such as the third coil and the fourth coil, are supplied to the transfer line and are welded together in sequence. The rear position coil of the coils in sequence is conveyed and is stacked over the forward coil on the exit side turn table. A predetermined number of coils which have been in a continuous state and are stacked, are consolidatedly taken out from the exit side turn table by a suitable taking-out means, and are made to be finished products.

Also, in a coil taking-up and stacking equipment of the present invention, the turn table device comprises a vertical positioning device which lowers the main body of the turn table device corresponding to the upper position of the coils which are stacked one by one for maintaining taking-up height of the strips, and a rotary driving device to rotate the table body for taking-up the strip between both coils. Further, the turn table device is provided with a guide roll device for taking-up guiding and an auxiliary guide roll device.

Further, the guide roll device for taking-up guiding is provided with a vertical roll facing the side planes of the coils and a horizontal roll facing the upper edge planes of the coils. The positions of both rolls may be changed according to the revolute (or external) winding or the involute (or internal) winding of the coils on the table body as well as the size of the strip. Also, the auxiliary guide roll device is adapted to chuck the strip between both coils until the transfer equipment passes through, and may adjust the strip feeding position depending on the external winding or the internal winding of the coil on the table body. At the same time the auxiliary guide roll device is adapted to push the strip into the turn table device according to the rotation of the table body.

Now, when a plurality of coils are taken up and stacked by the turn table in such a manner that the coils are stacked on their sides, a spacer is interposed between the stacked coils taking account of their after-treatment. Therefore, if there is such an abnormal condition in the sideway standing form of the coils as a tilt of the coils stacked on their sides or a warp of the uppermost coil, the guide roll device for taking-up guiding will interfere with the spacer. Particularly, since the vertical roll faces the side of the coil, its forward end (lower end) is always positioned below the upper side of the uppermost coil on the turn table device. Therefore, if there is any abnormality in the sideway stacking form of the coils, the vertical roll may interfere with the spacer or others to cause damage to the roll.

If the vertical roll is damaged, the taking up operation of the forward coil is hindered, so that an intended taking-up operation and eventually stacking operation may not be achieved.

Therefore, the coil taking-up and stacking equipment of the present invention is one in which a sort of safety mechanism is added to the guide roll device for taking-up guiding. More specifically, this guide roll device for taking-up guiding is based on a premise that the forward coil of the coils which are placed in the front and rear positions in the coil transfer direction and are connected to each other, is rotated in the horizontal state on the turn table device, and the rear coil is held and transferred in the horizontal state by the transfer equipment, and the rear coil is stacked over the forward coil as the rear coil is being taken up by the forward coil.

Further, it is based on a premise that the guide roll device for taking-up guiding is provided with a vertical roll facing the sides of the coils and a horizontal roll facing the upper edge planes of the coils, where the positions of both of these rolls can be changed according to the revolute winding or involute winding of the coil on the turn table device and the size of the strip.

Under such premises, according to the coil taking-up and stacking equipment the above-mentioned guide roll device comprises a sensor to detect the upper side of the coil so that the relationship between the positioning height of both of the vertical and horizontal rolls and the height of the upper side of the coil will be constant and a vertical driving system for both of the vertical and horizontal rolls which causes the vertical height of the both rolls to follow the upper side planes of the coils according to the measured value of the sensor.

Further, both of the vertical and horizontal rolls of the guide roll device for taking-up guiding are provided on an articulated robot hand, and the vertical roll is connected to a rotary driving device and may be driven rotatingly in such a manner that the roll faces the sides of the coils, and the horizontal roll is connected to a driving system for revolving and is able to determine its revolving position around the vertical roll according to the state of introduction of the coil which is guided.

The coils placed in the forward and rear positions in the direction of transfer of the coil and connected to each other are first stacked. One of the coils which is placed in the forward position is held in the horizontal state on the turn table device (actually the table body) and is rotated, while the coil in the rear position is held and transferred in the horizontal state by the transfer equipment. The forward coil takes up the strip between itself and the rear coil, and the rear coil approaches the forward coil and is eventually stacked over the forward coil. At this time, the forward coil on the table body rotates together with the table body by its own weight and takes up the strip while introducing the same in the revolute winding or involute winding state.

In taking up the coils, the guide roll device for taking-up guiding is positioned in combination with the forward coil by the articulate robot hand, and guides the forward coil so that it takes up the strip in an appropriate state and the coils are put in a desired form.

First, according to such a guiding function, the sensor operates in positioning the guide roll device for taking-up guiding the coil to measure the positioning height and the height of upper side plane of the coil on the table body and to send a signal to the vertical driving system for the vertical and horizontal rolls so that the positioning of both of these vertical and horizontal rolls relative to the coils is made at the optimum position, so that the vertical and horizontal rolls are moved in the vertical direction for effecting the optimum positioning (automatic follow-up function). Even when the coil has a tilt or warp generated therein, the vertical roll will not come in contact with the spacer because of such an automatic follow-up function.

Secondly, in the guide roll device for taking-up guiding, the vertical roll is positioned in correspondence with the side planes of the coils (an external circumferential position of the coil if the coil is in the revolute winding and an internal circumferential position of the coil if the coil is in the involute winding), and is rotatingly driven by its rotary driving system. Further, as the horizontal roll works facing the upper edge plane of the coil, the forward coil can effect the intended taking up and a desired form can be secured for the coils. The horizontal roll revolves, as required, around the vertical roll by its driving system for revolving, and is always positioned at an appropriate position relative to the strip which is guided.

DETAILED DESCRIPTION OF THE PREFERRED EMBODIMENT

Figure 1:
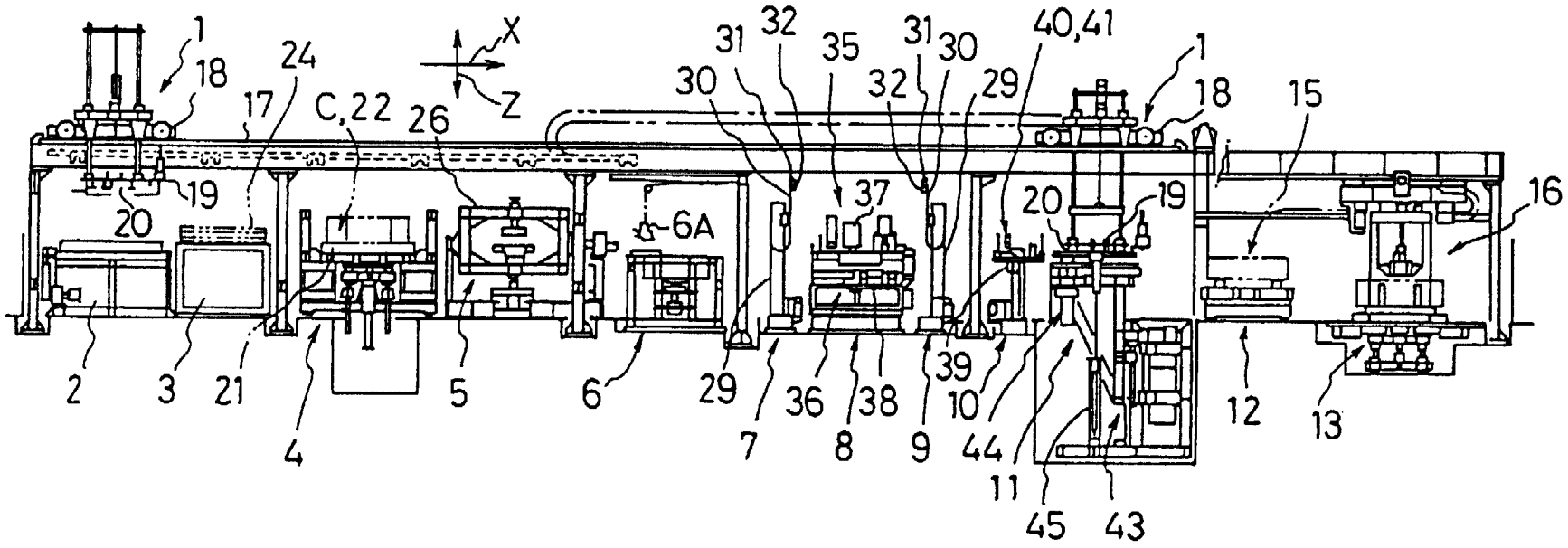
FIG. 1 is a general side view of various equipment used in a transfer method of the present invention.
Figure 2:
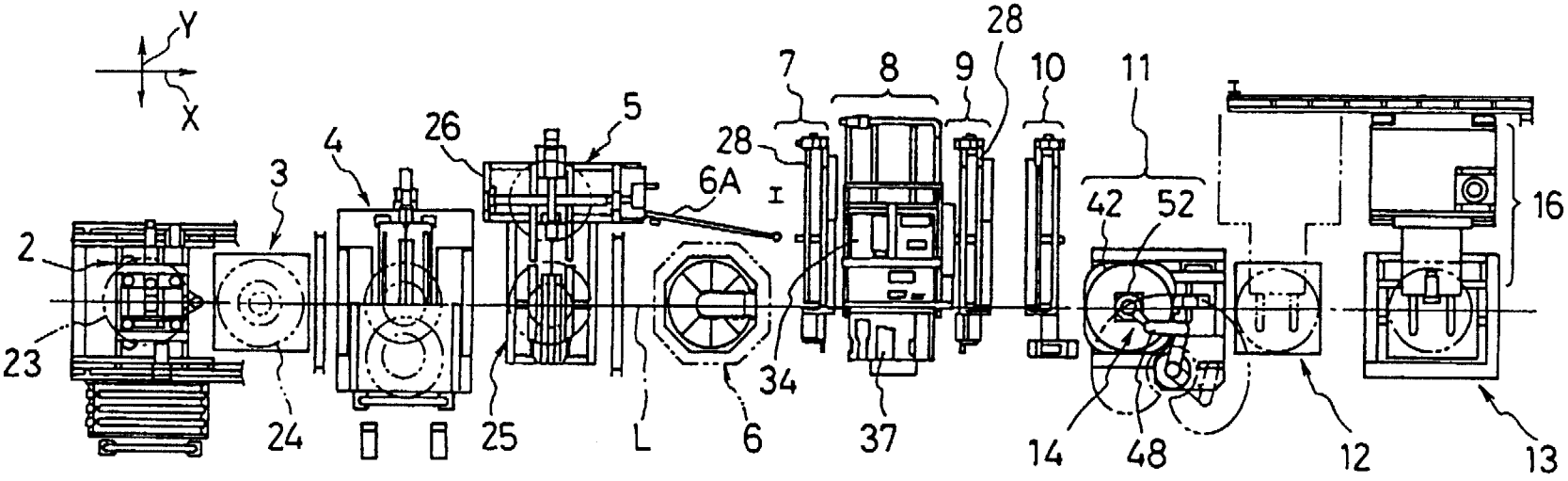
FIG. 2 is a general plan view of the various equipment shown in FIG. 1.

Now, an embodiment of the present invention will be explained by referring to the drawings. First, explanations will be made on the general aspect of the embodiment such as the arrangement and orientation of various kinds of equipment. In FIG. 1 and FIG. 2, the left side and the right side in the drawings will be defined as the entry side and the exit side, respectively, and the following various processing equipment are arranged in turn.

In the explanations given above and below, in FIG. 1 and FIG. 2, the right side is defined as the "front" and the left side is defined as the "rear", the direction from the front to the rear is represented by arrow X. The upper section in FIG. 1 is defined as the "upper" side and the lower section is defined as the "lower" side. The up and down directions are represented by arrow Z. Further, the upper side in FIG. 2 is defined as the "left" side and the lower side is defined as the "right" side, and the left and right directions are represented by arrow Y.

Various kinds of processing equipment are positioned in turn from the entry side to the exit side. In the upper area (upper space) of the section extending from the entry side to the exit side, a transfer equipment 1 as "transfer means" is retractably provided, so that an overall transfer line L in which the various kinds of equipment are combined to each other is formed. The transfer equipment 1 is retractably moved in the upper area of the section extending from the entry side to the exit side, and selects an equipment needed for accomplishing a process from various kinds of equipment and stops at the position above the selected equipment to take up the coil C with suction means or to make it possible to supply the coil C.

As for the various equipment, in the order from the entry side to the exit side, an escape table 2, a tentative stock table 3, a carry-in table 4, an inverting table 5, an entry side turn table 6, an entry side guide roll 7, a welding machine 8, an exit side guide roll 9, an additional guide roll 10, and an exit side turn table 11, a weighing equipment 12, and a packing table 13 are provided.

Here, a guide roll device 14 for taking-up guiding is combined to the exit side turn table 11. An exit side transfer equipment 16 is provided separately from the above mentioned transfer equipment 1 for taking out a plurality of coils 15 together which have been stacked on the exit side turn table 11 and connected to one another in a continuous form, in such a manner that the equipment 16 is retractably moved among the exit turn table 11, the weighing equipment 12 and the packing table 13.

Now, each of the various equipment will be explained, and then a method of transferring the coils using such equipment will be explained.

Transfer equipment 1

The transfer equipment 1 takes out a coil C from a processing equipment by vacuum sucking and holds it in the horizontal posture, and then transfers and supplies the coil to another processing equipment to be required. When the processing in the equipment is completed, the equipment 1 vacuum sucks the coil C again and takes out and holds it in the horizontal state, and then transfers the coil C to the next processing equipment, generally from the left side to the right side in FIG. 1.

Therefore, a transfer rail 17 is provided above the various equipment from the entry side to the exit side. A truck 18 which freely moves back and forth is placed on the transfer rail 17. A suspending base 19 which is vertically movable is provided on the truck 18, and a plurality of vacuum pads 20 which suck the upper side of the coil C are provided on the base 19. The transfer equipment 1 effects the centering of the coil C in the X direction, and detects the outer diameter of the coil C by a sensor not shown in the drawing and transmits the data to each of the equipment.

Carry-in table 4

The carry-in table 4 receives a plurality of coils 22 together with a pallet 21 for the first time when the plurality of coils 22 which are in the respectively independent state (discontinuous state) and stacked on their sides on the pallet 21 beforehand are supplied to the transfer line L by a forklift not shown in the drawing. The table 4 effects the centering of each coil C in the Y direction when the transfer equipment 1 takes out the coil C as the first coil C1, the second coil C2, the third coil C3, etc. which is always positioned uppermost on the carrying-in table 4. The carry-in table 4 receives the plural coils 22 for the time being regardless of whether the coil is a non-defective coil, a coil to be returned (defective coil) 23, or a coil to be reworked 24.

Escape table 2 and temporary stock table 3

If the coil C on the carry-in table 4 is the returned coil 23, it is sucked and hoisted by the transfer equipment 1, and then is transferred to the escape table 2 to be stocked there. The coil is properly taken out of the transfer line L. On the other hand, if the coil C is the reworked product 24, the coil is also transferred to the temporary stock table 3 where the coil is subjected to the necessary processing, and is conveyed by the transfer equipment 1 to the exit side turn table 11, the entry side turn table 6 or the inverting machine 5.

Inverting table 5

The inverting table 5 inverts the coil C for changing the direction of winding the coil C, where an inverting machine 26 is combined to a table body 25. The coil C which is required to be inverted is supplied to the table body 25 by the transfer equipment 1. Then the coil is sent from the table 25 to the adjacent inverting machine 26, where the coil C is chucked by an air spring and will be subjected to the inversion processing. After the inversion the coil C is returned from the inverting machine 26 to the former table body 25 and is moved by the transfer equipment 1.

Entry side turn table 6

The entry side turn table 6 receives the coil C for carrying out the welding process. The received coil C is handled as the "rear coil". In the table 6 the external or internal periphery of the coil C is unwound so that its strip 27 can be made easy to be taken out, and bundling belts are wound round the coil at several positions to temporarily bundle the coil C. A manual bundling machine 6A with a balancer is assembled for the sake of the tentative bundling.

Entry side guide roll 7 and exit side guide roll 9

The entry side guide roll 7 and the exit side guide roll 9 have the similar structure and are respectively placed at the entry side and at the exit side of the welding machine 8. Therefore, explanations will be made on one of them, that is, the entry side guide roll 7 for the convenience of explanation, while the corresponding components of the other one, the exit side guide roll 9 will be merely shown with the same identification numbers.

The entry side guide roll 7 is retractably moved (is able to retract and return) on a rail 28 positioned in the Y direction. In the guide roll 7 an upper clamp roll 31 and a lower driving roll 32, which are formed as an up and down pair in a horizontal state, are provided on a support base 30 which is vertically movable on a shaft 29.

The upper clamp roll 31 is adapted to be opened and closed relative to the lower driving roll 32. The roll 31 has a state of chucking the strip 27 in cooperation with the lower driving roll 32 when closed, and a guide state of letting the strip 27 pass therethrough when opened. At the time of the welding process, the upper clamp roll 31 is used as an auxiliary guide roll, and after the welding it is used as a delivery roll for sending the strip 27. However when the rear coil RC on the entry side turn table 6 is taken up and conveyed by the transfer equipment 1, the roll 31 retracts from the transfer line L and is totally moved to a position where there is no occurrence of the interference with the rear coil RC and the strip 27 extending therefrom.

Here, the height positions of the upper clamp roll 31 and the lower driving roll 32 are automatically positioned to the position inputted into a control device not shown in the drawing, and further their positions in the Y direction are automatically positioned by inner and outer diameters of the coil C.

Welding machine 8

The welding machine 8 is an apparatus to weld ends of a strip 33 of the "forward coil FC" and a strip 27 of the "rear coil RC", to effect a finishing process thereon, and then to perform a marking process on the welded parts. The welding machine 8 comprises mainly a truck 34 which can advance and retract itself in the Y direction, an upper unit 35 provided in such a manner that the unit 35 can be advanced and retracted in the same Y direction on the truck 34, and a lower unit 36 provided at the forward end of the truck 34 in such a manner that the unit 36 can move up and down in the Z direction. A main body 37 of the welding machine is installed in the upper unit 35 while a dryer 38 is attached to the lower unit 36.

At the time of welding the upper unit 35 protrudes itself to the forward end, and after the welding the upper unit 35 moves to the left side in the Y direction. The lower unit 36 ascends to a space created by the movement of the unit 35 for the drying process. When the processes necessary for the welding are all completed, the entire machine with the truck 34 retracts to the left side in the Y direction and prepares for the taking up of the strips 27, 33 , the absorbing of the sag therein and the transfer of the rear coil RC.

Auxiliary guide roll 10

The auxiliary guide roll 10 is an equipment to work as a push-in roll when the strips 27, 33 are taken up and their sags are absorbed by the forward coil FC on the exit side turntable 11.

A roll supporting part 39, which can advance and retract in the Y direction and at the same time can have its height adjusted in the Z direction, is provided. A group of the guide rolls represented by horizontal pinch rolls 40, 41, which (drive as an up and down pair, are provided at the roll supporting part 39. The horizontal pinch rolls 40, 41 chuck the strips 27, 33 in cooperation with each other, and at the same time when the transfer equipment 1 approaches in such a manner that the transfer equipment 1 goes beyond this auxiliary guide roll 10, the upper horizontal pinch roll 40 is opened to release the binding of the strips 27, 33 and presents a free state. When the upper horizontal pinch roll 40 is closed, the lower horizontal pinch roll 41 conveys the strips 27, 33 by its rotary driving force from the entry side to the exit side, for pushing the strips 27, 33 into the forward coil FC on the turn table 11.

As the transfer equipment 1 approaches soon, the chucking state of the strips 27, 33 is released as mentioned above, and the entire roll assembly moves (retracts) in the Y direction and comes to a position where no interference is made on the movement of the transfer equipment 1, that is the movement of the strips 27, 33. At this point the forward coil FC on the turn table 11 has almost completed the taking-up action leaving a very short portion of the strips 27, 33 between the forward coil FC and the rear coil RC unwound, so that the taking-up action can be continued without placing a burden over the forward coil FC by the taking up action of the turn table 11 and the retention of the rear coil RC by the transfer equipment 1.

Exit side turn table 11

The exit side turn table 11 is an equipment to receive the forward coil FC, and to rotate after the welding for taking up the strips 27, 33 between the forward coil FC and the rear coil RC, and eventually to receive the rear coil RC in such a state that the rear coil is stacked over the forward coil FC.

And, a vertical positioning device 43 which lowers a table body 42 in correspondence with the upper plane position of the plurality of consecutively stacked coils 15 and positions the taking-up height of the strips 27, 33 to a predetermined position, and a rotary driving device 44 to rotate the table body 42 are provided in the exit side turn table 11.

The table body 42 has an opening at its center and a tubular guide 52 is positioned over the opening. The tubular guide 52 is assembled to the forward end of a rod of a pressure cylinder 45, and the entire table can move up and down. At the same time a plurality of split plane parts forming a tubular plane can expand and shrink their diameters by a pressure cylinder which is placed inside but is not shown in the drawing. The tubular guide 52 works as a guide for determining an inserting position of a spacer (not shown in the drawing) which is placed between the plurality of coils 15 on the table body 42, when the diameter is expanded.

Guide roll device 14 of taking-up guiding

The guide roll device 14 for taking-up guiding is assembled to the exit side turn table 11. This guide roll device 14 for taking-up guiding has a vertical roll 46 corresponding to the side of the forward coil FC and a horizontal roll 47 corresponding to the upper edge plane of the forward coil FC both of which are assembled to the forward end of an articulated robot hand 48, where both rolls 46, 47 can have their positions changed according to the revolute winding or involute winding of the forward coil FC on the table body 42 and the size of the strips 27, 33.

The exit side turn table 11 and the guide roll device 14 for taking-up guiding mentioned above will be explained in further detail later in relation to a coil taking-up and stacking equipment of the present invention.

Next, each process of the transfer method will be explained by referring to FIGS. 3 to 17.

Supply of coils

Figure 3:
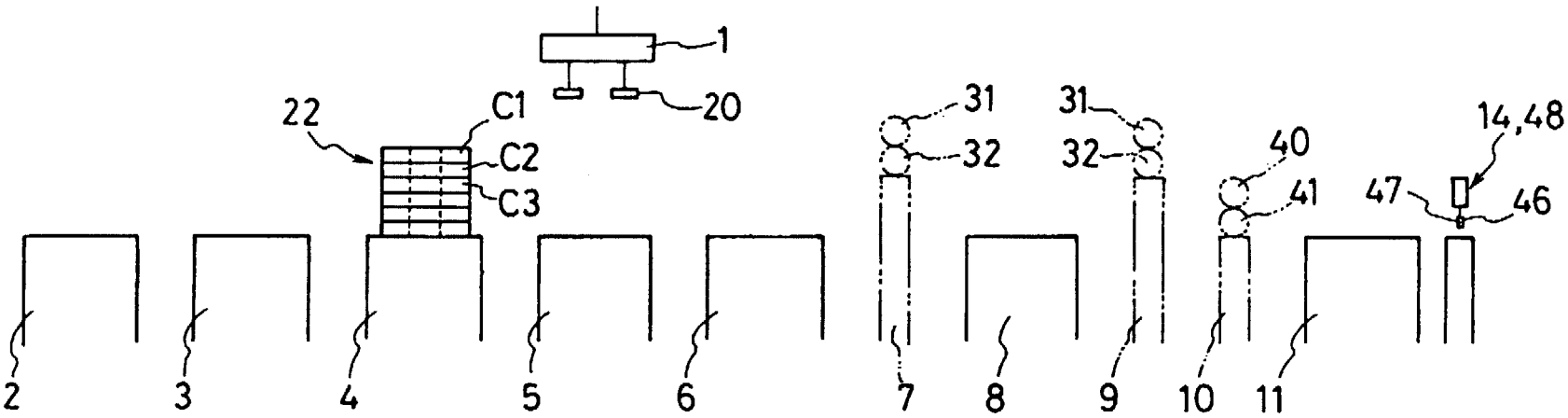
FIG. 3 is a schematic view showing a coil transfer apparatus having a plurality of coils on a carry-in table.
Figure 4:
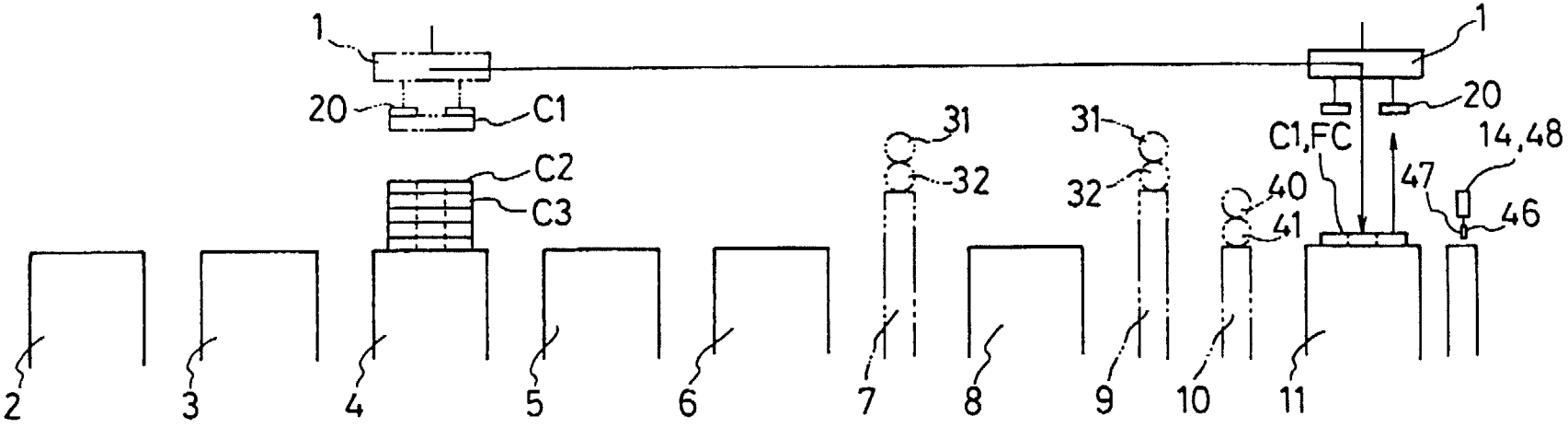
FIG. 4 is a schematic view showing a coil transfer apparatus with a first coil being transferred to an exit side turntable.

① A process to carry the plurality of coils, which are individually independent of each other and are stacked on their sides, into the carry-in table 4 (Refer to FIG. 3);

② A process to convey the first coil C1 on the carry-in table by the transfer equipment 1 which is a transfer means to the exit side turn table 11:

As shown in FIG. 4, the transfer equipment 1 sucks the first coil C1 at the uppermost position of the plurality of coils 22 with a plurality of vacuum pads 20 and brings it up (hoists), and moves it to the X direction on the transfer rail 17, and then stops it at the upper position corresponding to the exit side turn table 11, and lowers the suspending base 19 and releases the suction of the vacuum pads 20, so that the first coil C1 is supplied onto the exit side turn table 11 and is designated as the forward coil FC.

Figure 5:
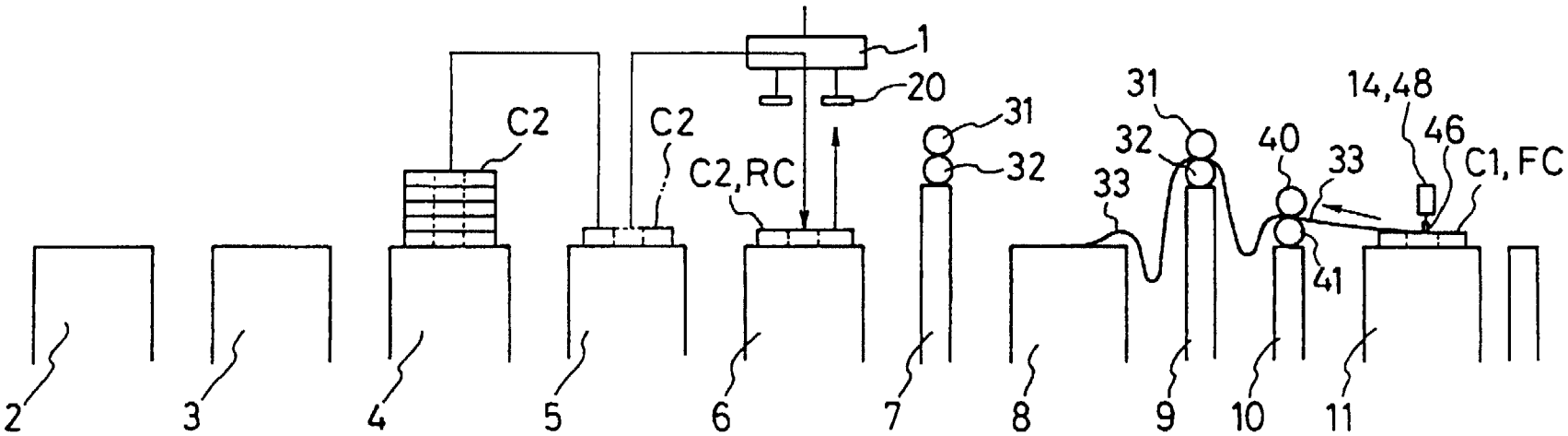
FIG. 5 is a schematic view showing a coil transfer apparatus during the transfer of a second coil to an inverting table and then to an entry side turntable, and the feeding of a strip from the forward coil to the welding machine.

③ A process of pulling out a strip 33 out of the forward coil FC which has been supplied to the exit side turn table 11, and supplies it to the welding machine 8 through the auxiliary guide roll 10 and the exit side guide roll 9:

As shown in FIG. 5, the strip 33 is pulled out and its forward end is supplied to the welding machine 8 through the auxiliary guide roll 10 and the exit side guide roll 9.

④ A process of supplying the second coil on the carry-in table as required by the transfer equipment 1 which is a transfer means to the inverting table 5, inverting it to take it out, and then conveying the same to the entry side turntable 6:

Also as shown in FIG. 5, the second coil C2 is moved by the transfer equipment 1 to the inverting table 5 for changing the winding direction of the coil, then it is conveyed by the transfer equipment 1 to and supplied to the entry side turn table 6.

Figure 6:
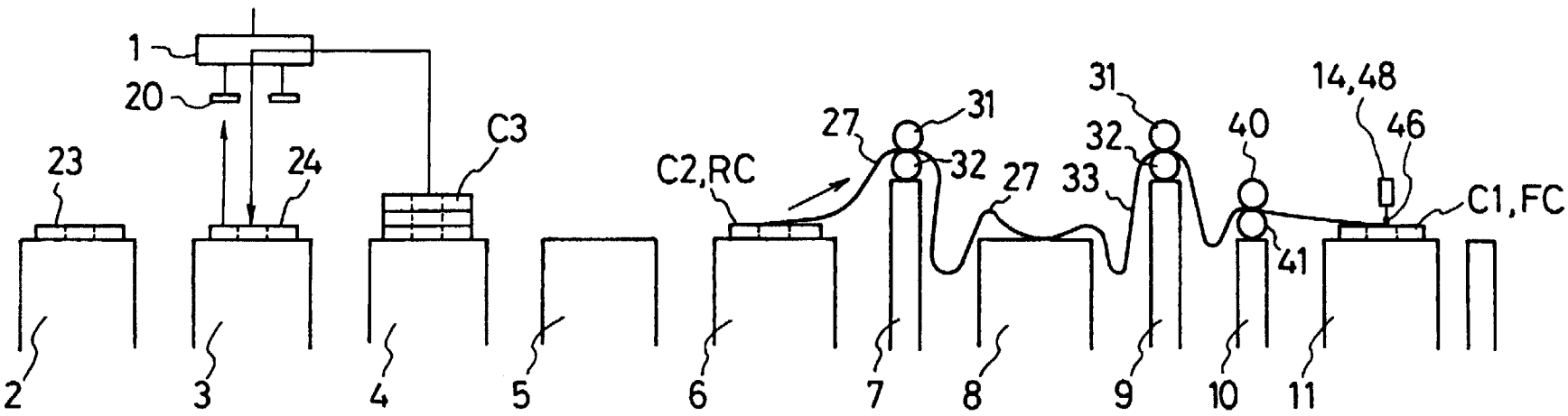
FIG. 6 is a schematic view showing a coil transfer apparatus during the feeding of a strip of material from the second coil to the welding machine.

⑤ A process of pulling out the strip from the coil supplied to the entry side turn table 6, which is designated as the rear coil RC, and supplies it to the welding machine 8 through the entry side guide roll 7:

Next, as shown in FIG. 6, the strip 27 is pulled out from the rear coil RC and the forward end of the strip is supplied to the welding machine 8 through the entry side guide roll 7. If the third coil C3 is non-defective product, it is placed in a stand-by state at the carry-in table 4 or is conveyed to the inverting table 5 depending on the winding direction of the coil, and if the coil C3 is a product to be reworked 24 or a product to be returned 23, it is conveyed to the tentative stock table 3 or the escape table 2.

Welding

Figure 7:
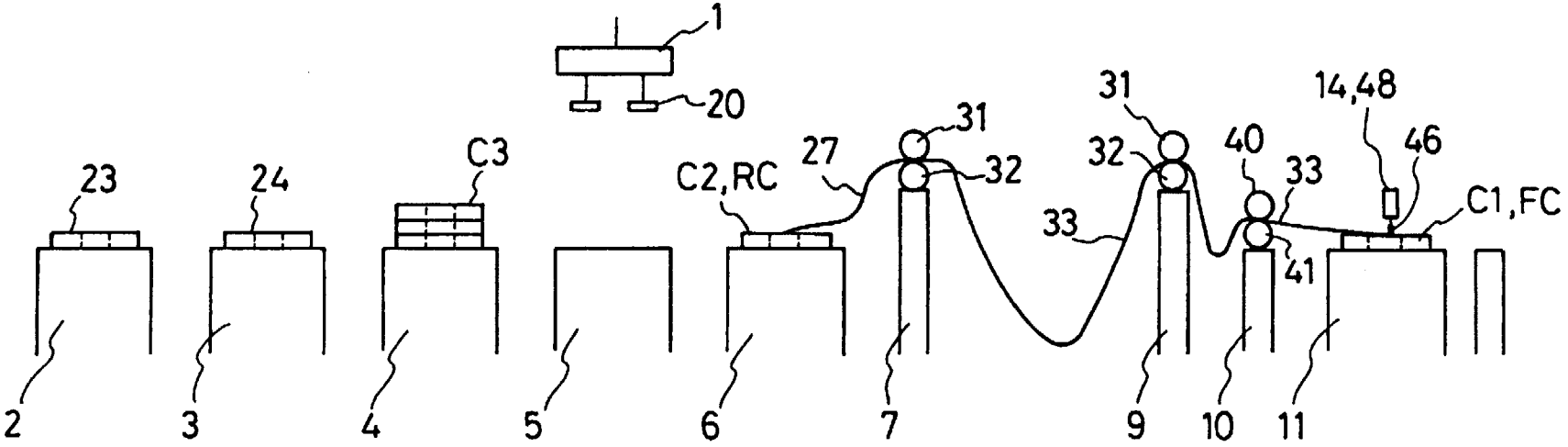
FIG. 7 is a schematic view showing a coil transfer apparatus after the welding machine has been retracted from the transfer line.

⑥ A process of welding together ends of the strips 27, 33 of both the forward and rear coils, FC and RC, by the welding machine 8, thus effecting a continuation process for both the forward and rear coils, FC and RC, and then after the welding retracting the welding machine 8 from the transfer line L:

Ends of strips 33, 27 are welded together by the main welding part 37 of the welding machine 8 and suitable finishing processes are made by a dryer 38 and others. The welded portion will have a predetermined marking placed thereon. And as shown in FIG. 7, the welding machine 8 is moved together with the truck 34 in the Y direction, thus retracting it from the transfer line L.

Absorbing the sag in strip

Figure 8:
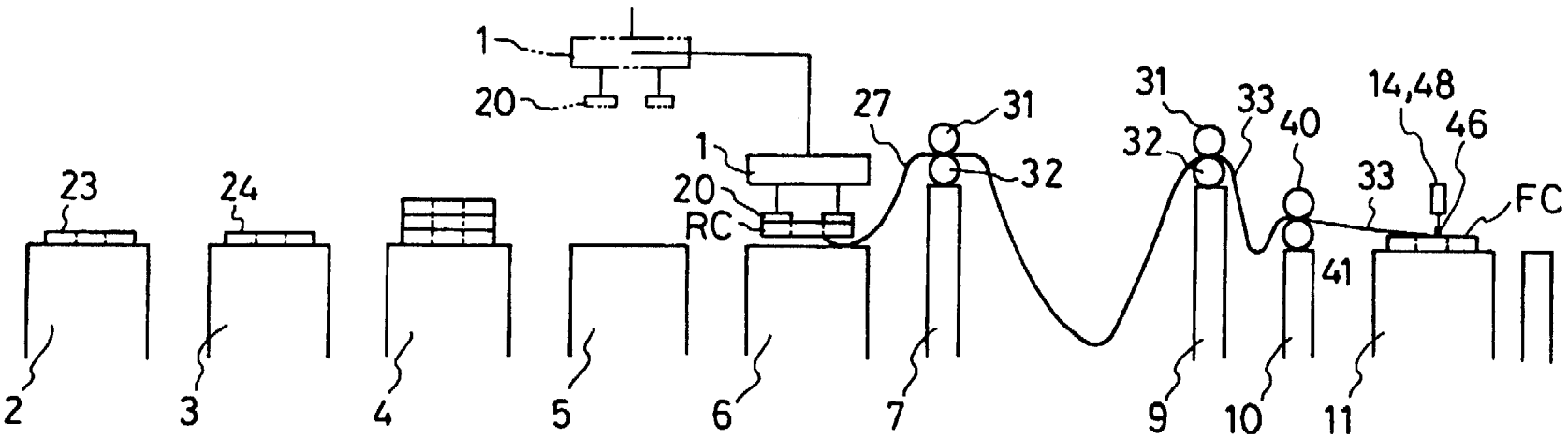
FIG. 8 is a schematic view showing a coil transfer apparatus as the transfer equipment picks up the rear coil.
Figure 9:
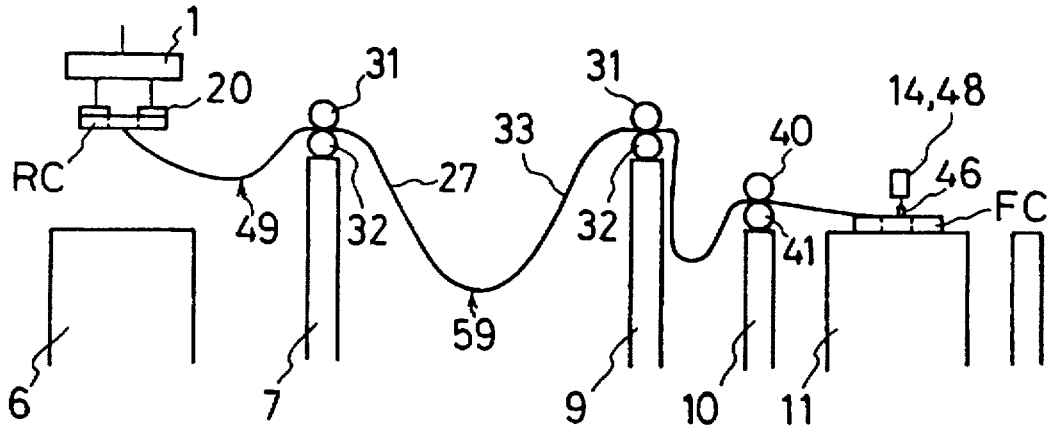
FIG. 9 is a schematic view showing a coil transfer apparatus as the rear coil is moved to the stand-by position.
Figure 10:
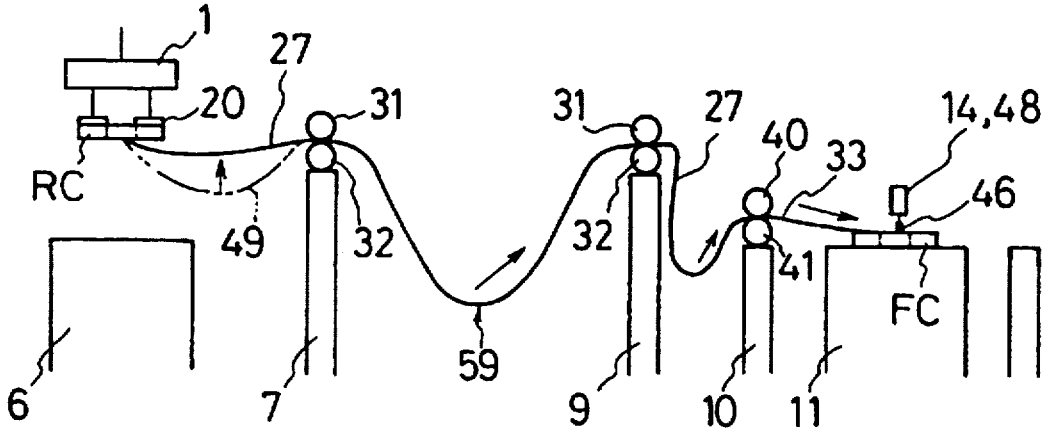
FIG. 10 is a schematic view showing a coil transfer apparatus during the removal of sag from the strip.
Figure 11:
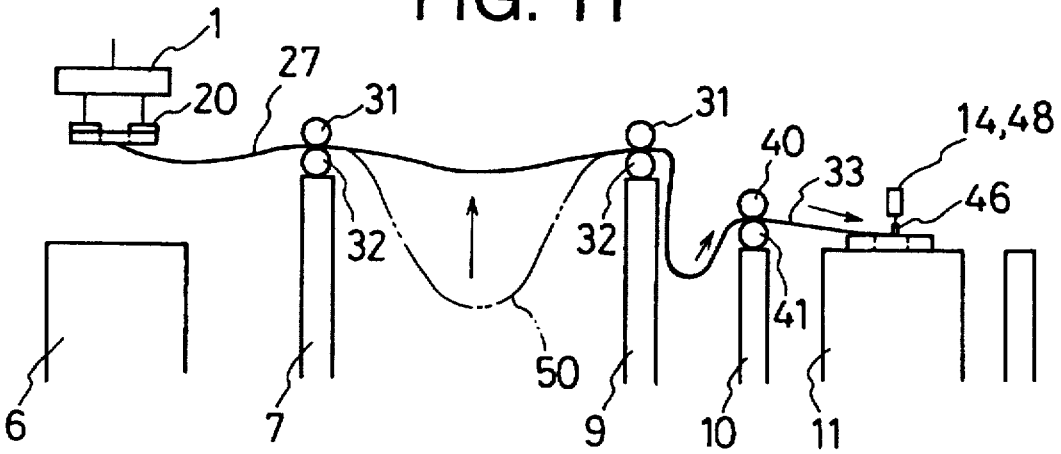
FIG. 11 is a schematic view showing a coil transfer apparatus during the removal of sag from the strip.

⑦ A process of synchronizedly rotating the entry side guide roll 7, the exit side guide roll 9, the auxiliary guide roll 10, the exit side turn table 11, etc. in such a state that the rear coil RC on the entry side turn table 6 is hoisted by the transfer equipment 1 which is a transfer means and is held in a stand-by posture, and taking up and absorbing the sag 49 in the strip 27 between the entry side turn table 6 and the entry side guide roll 7 and the sag 50 in the coils 27, 33 between the entry side guide roll 7 and the exit side guide roll 9 in turn by the forward coil FC:

As shown in FIG. 8, the transfer equipment 1 is moved to the upper position corresponding to the entry side turn table 6, sucks and pick up the rear coil RC, and then is placed in a stand-by posture as shown in FIG. 9. As shown in FIG. 10, the entry side guide roll 7, the exit side guide roll 9, the auxiliary guide roll 10, the exit side turn table 11, the vertical roll 46 of the guide roll device 14 for taking-up guiding, etc. are synchronizedly rotated for taking up and absorbing the sag 49 in the strip 27 between the entry side turn table 6 and the entry side guide roll 7 by a rotation of the forward coil FC. Further, as shown in FIG. 11, the exit side guide roll 9, the auxiliary guide roll 10, the exit side turn table 11, the vertical roll 46, etc. are synchronizedly rotated for taking up and absorbing the sag 50 in the strips 27, 33 between the entry side guide roll 7 and the exit side guide roll 9.

Transfer and stacking of rear coil

Figure 12:
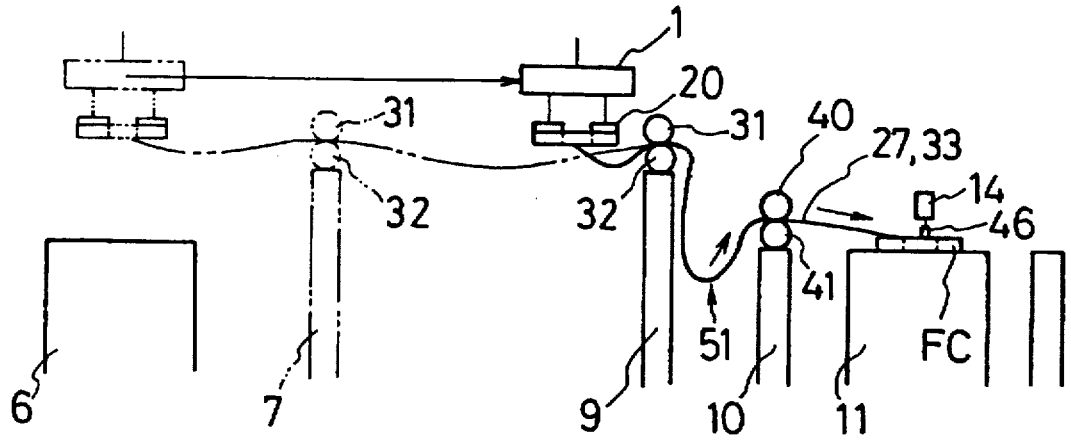
FIG. 12 is a schematic view showing a coil transfer apparatus as the rear coil is moved toward an exit guide roll by the transfer equipment.

⑧ A process of taking up and absorbing the sag 51 in the strips 27, 33 by the forward coil FC as the rear coil RC which has been taken out and placed in a stand-by posture is conveyed by the transfer equipment 1 which is a transfer means to and is made to approach to the exit side turn table 11, and retracting the entry side guide roll 7, the exit side guide roll 9, the auxiliary guide roll 10, etc. in turn from the transfer line L according to the approach of the transfer equipment 1:

As shown in FIG. 12, the transfer equipment 1, the entry side guide roll 7, the exit side guide roll 9, the auxiliary guide roll 10, exit side turn table 11, the vertical roll 46, etc. are synchronizedly rotated and the entry side guide roll 7 is retracted according to the approach of the transfer equipment 1.

Figure 13:
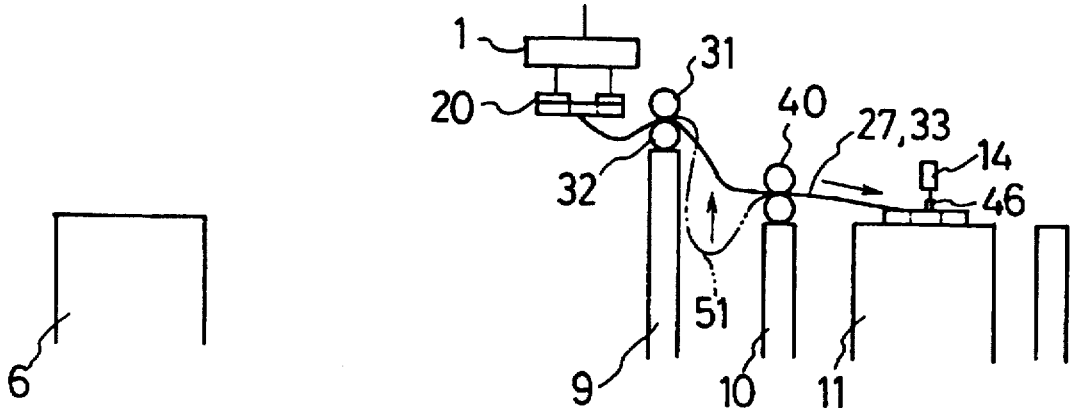
FIG. 13 is a schematic view showing a coil transfer apparatus during the removal of sag from the material strip.

Next, as shown in FIG. 13, the exit side guide roll 9, the auxiliary guide roll 10, the exit side turn table 11, the vertical roll 46, etc. are synchronizedly rotated and the sag 51 remaining between the exit side guide roll 9 and the auxiliary guide roll 10 is taken up and absorbed.

Figure 14:
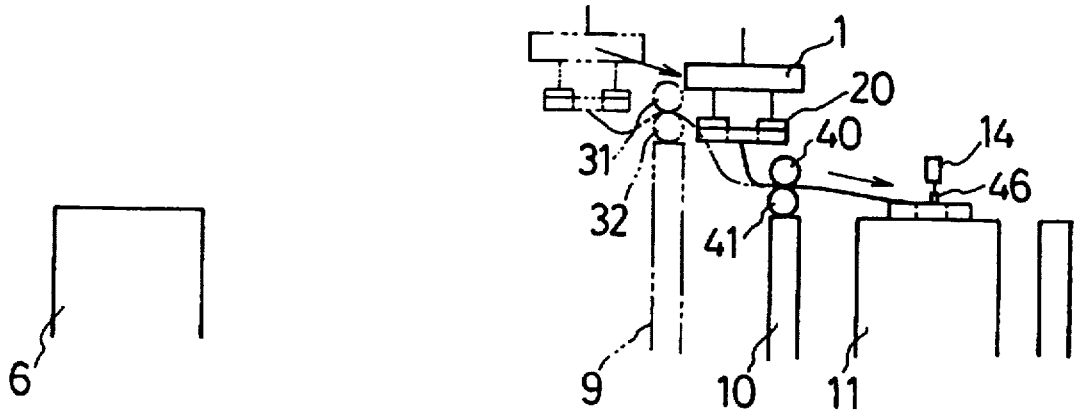
FIG. 14 is a schematic view showing a coil transfer apparatus as the exit side guide roll is withdrawn from the transfer line.

As shown in FIG. 14, the transfer equipment 1, exit side guide roll 9, the auxiliary guide roll 10, the exit side turn table 11, the vertical roll 46, etc. are synchronizedly rotated, and the exit side guide roll 9 is retracted according to the approach of the transfer equipment 1.

Figure 15:
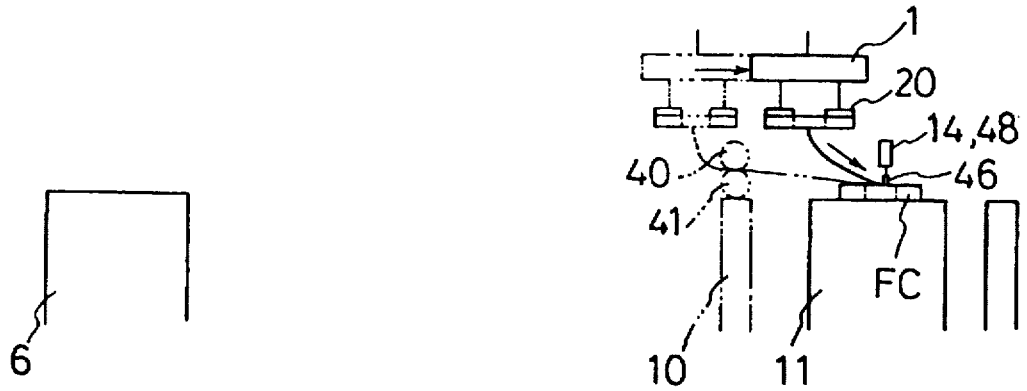
FIG. 15 is a schematic view showing a coil transfer apparatus as the auxiliary guide roll is retracted from the transfer line.

As shown in FIG. 15, the transfer equipment 1, the auxiliary guide roll 10, the exit side turn table 11, the vertical roll 46, etc. are synchronizedly rotated, and the auxiliary guide roll 10 is retracted according to the approach of the transfer equipment 1.

Figure 16:
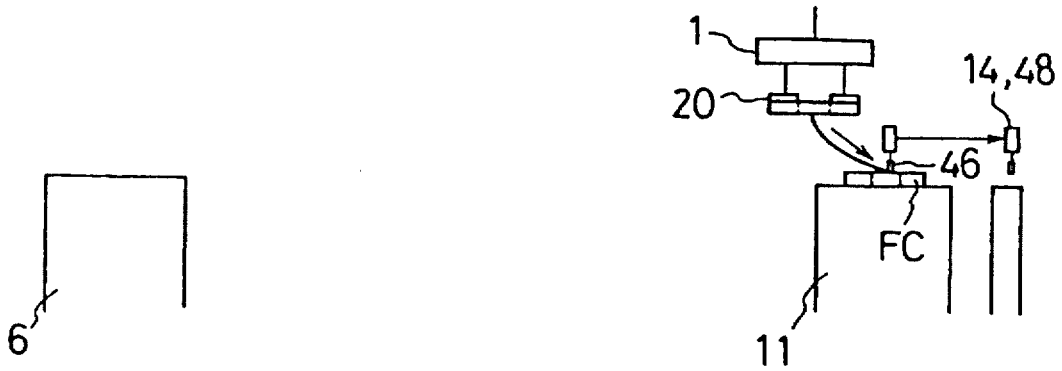
FIG. 16 is a schematic view showing a coil transfer apparatus as a vertical roll is retracted from the forward coil.

Further, as shown in FIG. 16, the transfer equipment 1, the exit side turn table 11, the vertical roll 46, etc. are synchronizedly rotated, and the vertical roll 46 (in the guide roll device 14 for taking up guiding ) is retracted during such a synchronized rotation. At this point, the strips 27, 33 are almost totally taken up by the forward coil FC.

Figure 17:
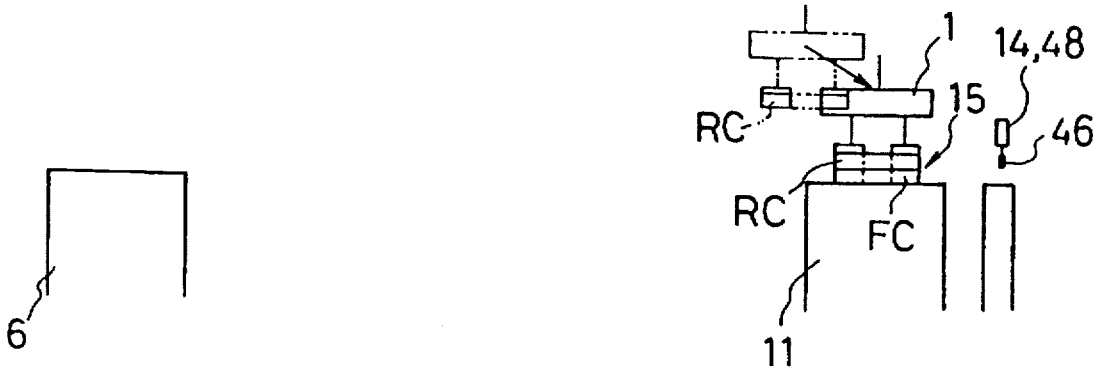
FIG. 17 is a schematic view showing a coil transfer apparatus as the rear coil is placed on the forward coil.
Figure 18:
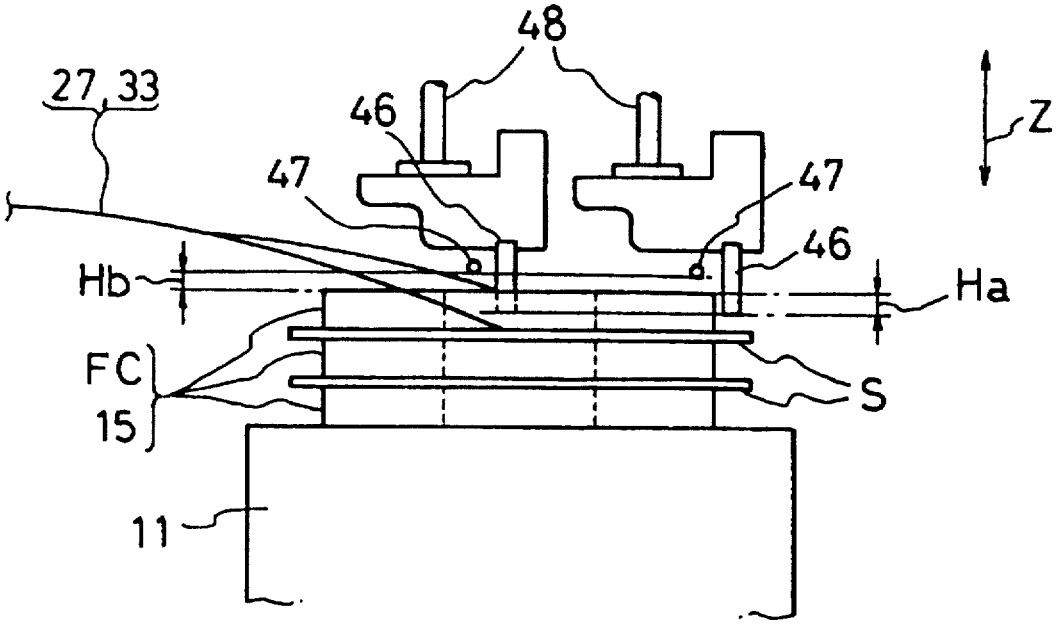
FIG. 18 is a schematic view showing a positional relationship of a guide roll device for taking-up guiding corresponding to involute and revolute windings of the coils.

⑨ A process of stopping the transfer equipment 1 at the upper position corresponding to the exit side turn table 11 and supplying the rear coil RC onto the forward coil FC and stacking it thereon:

As shown in FIG. 17, the transfer equipment 1 and the exit side turn table 11 are synchronizedly rotated, and then the synchronized rotating is stopped at a point when the transfer equipment 1 comes to the upper position corresponding to the exit side turn table 11. In such a state that the spacers are inserted appropriately by an operator, the rear coil RC is stacked over the forward coil FC.

The third coil C3 which has been held in a stand-by posture is conveyed by the transfer equipment 1 and is designated as the rear coil RC this time, and the above mentioned second coil C2 (the rear coil RC mentioned above) which has been stacked on the exit side turn table 11 is designated as the forward coil FC this time, and the above mentioned process is repeatedly done, and a plurality of coils 22 on the carry-in table 4 are welded and are transferred to the exit side turn table 11 to form a plurality of stacked coils 15. Then the coils are consolidatedly taken out from the exit side turn table 11 by the exit side transfer equipment 16 and are weighed and packed, and then the coils are finally taken out as the products from the packing table 13.

As has been explained, according to the coil transfer method of the present invention, a plurality of coils with large size and heavy weight are conveyed by the transfer equipment and strips supplied to the welding machine are welded in turn, then the strip and sags in the strips are taken up and absorbed by a rotation of the forward coil without scratching the strips, and a plurality of coils in a continuous form are formed by stacking the rear coils on the forward coil on the exit side turn table. Finally the coils can be taken out in the last stage as a consolidated product from the transfer line. Thus the invention has a remarkable effect that a continuous transfer process which is in correspondence to the properties of the coil and its strip can be achieved.

Next, taking-up and stacking equipment of the present invention will be explained in further detail by referring to FIG. 1 and FIGS. 18–26.

As has been explained above, the transfer equipment 1 vacuum sucks the uppermost coil out of the plurality of coils 22 stacked on the carry-in table 4, holds it in a horizontal posture, and then transfer the same to an equipment where the necessary processing is to be done. Then, when such necessary processing is finished, the transfer equipment vacuum sucks the coil again, holds it in a horizontal posture and transfers it to the next equipment, that is the coil is transferred from the left side to the right side in FIG. 1. Here, the transfer equipment 1, the exit side turn table 11 and the guide roll 14 for taking-up guiding as a coil taking-up and stacking equipment according to the present invention will be explained below in detail.

Figure 25:
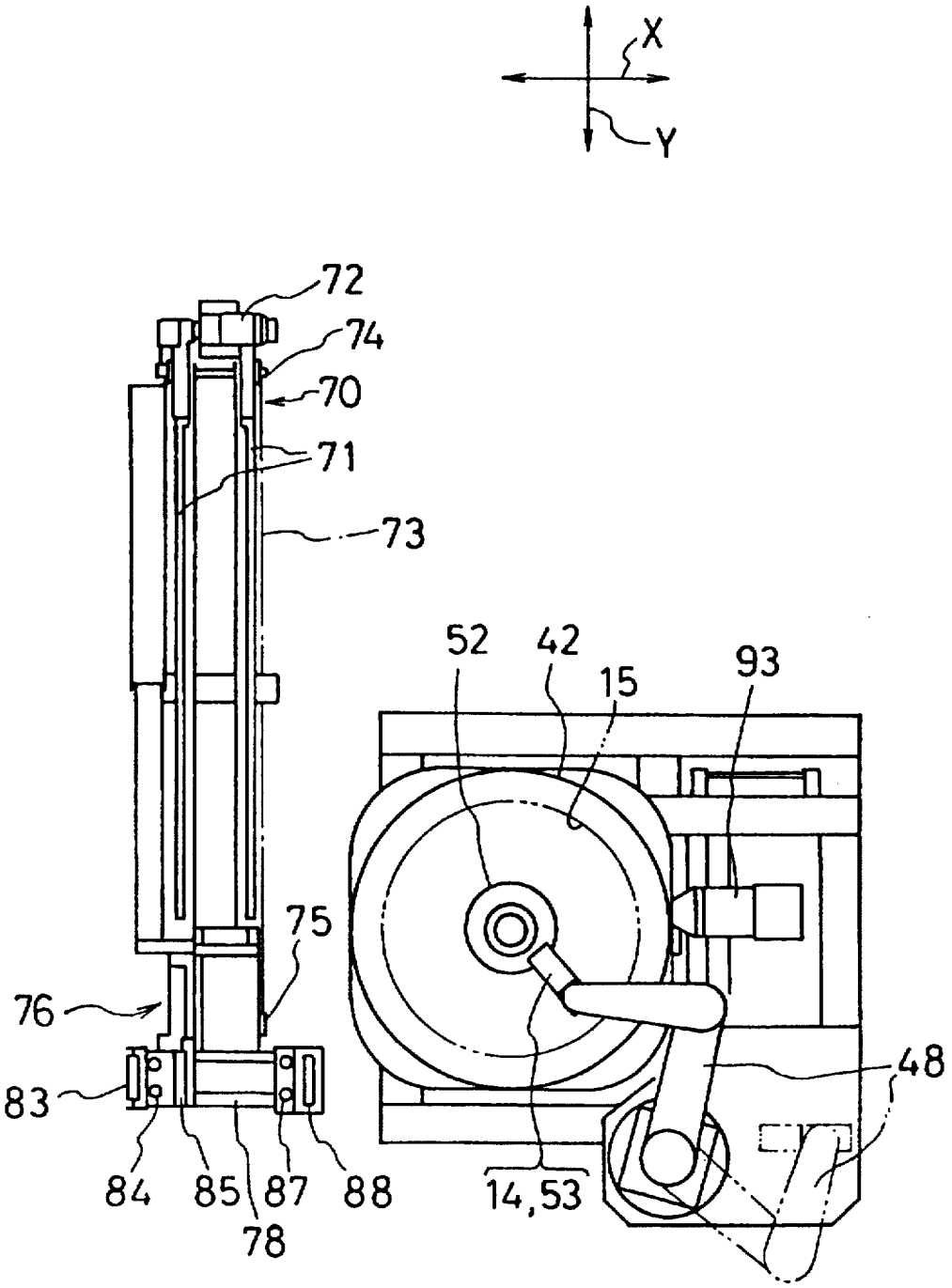
FIG. 25 is a plan view of the turn table device (in such a state that the guide roll device for taking-up guiding is assembled in place)

Here, in the explanations given above and to be given below, the right side in FIG. 1 is designated as the "front or forward", and the left side is designated as the "rear". The back and forth direction is represented by arrow X, then the upper area in FIG. 1 is designated as the "upper or above" side and the lower direction is designated as the "lower or below" direction, where the up and down directions are represented by arrow Z, further the upper area in FIG. 25 is designated as the "left" and the lower direction is designated as the "right", where the left and right directions are represented by arrow Y.

Now, each major constituent part will be explained in turn.

Figure 24:
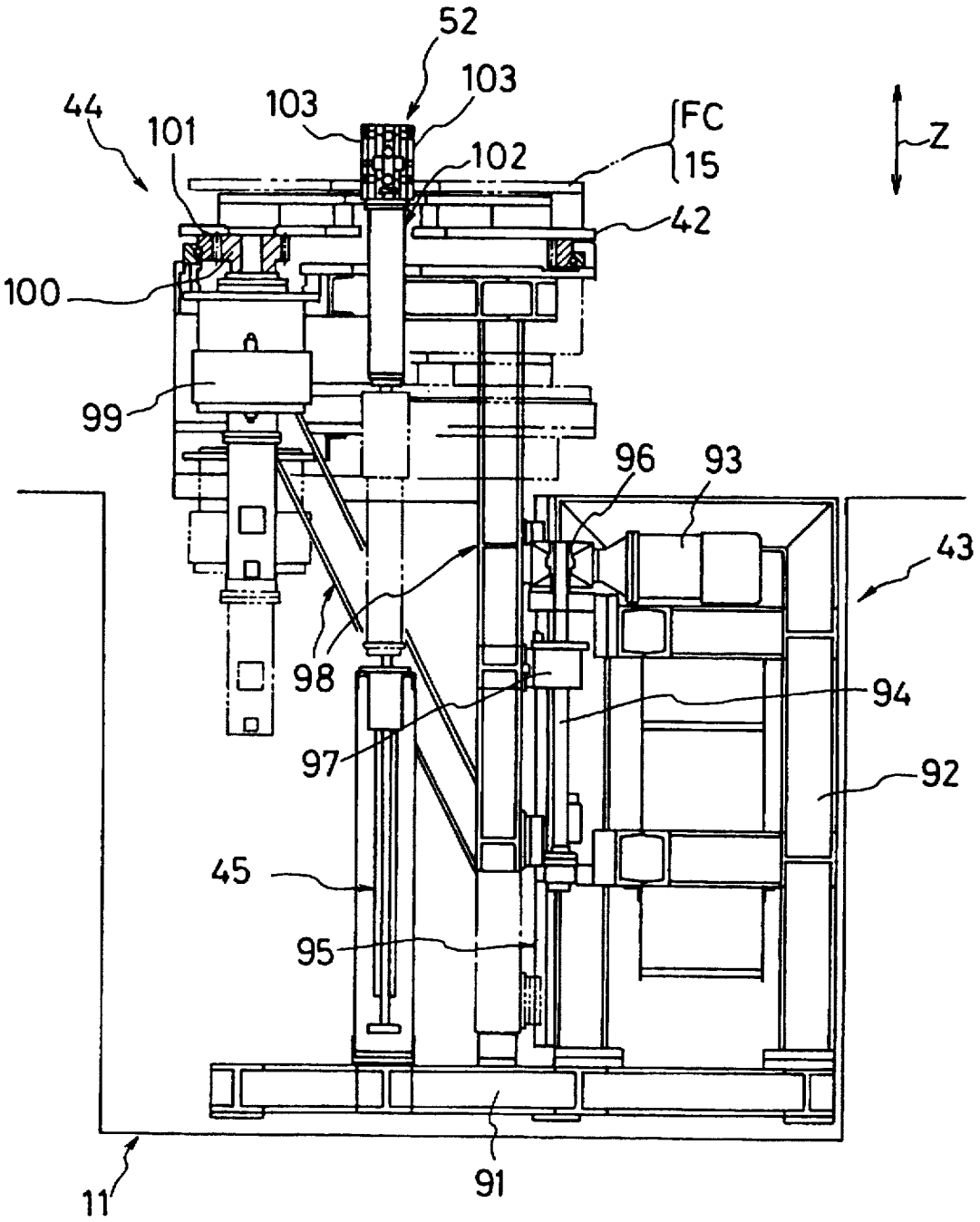
FIG. 24 is a side view of a turn table device (in such a state that the guide roll device for taking-up guiding is omitted)
Figure 26:
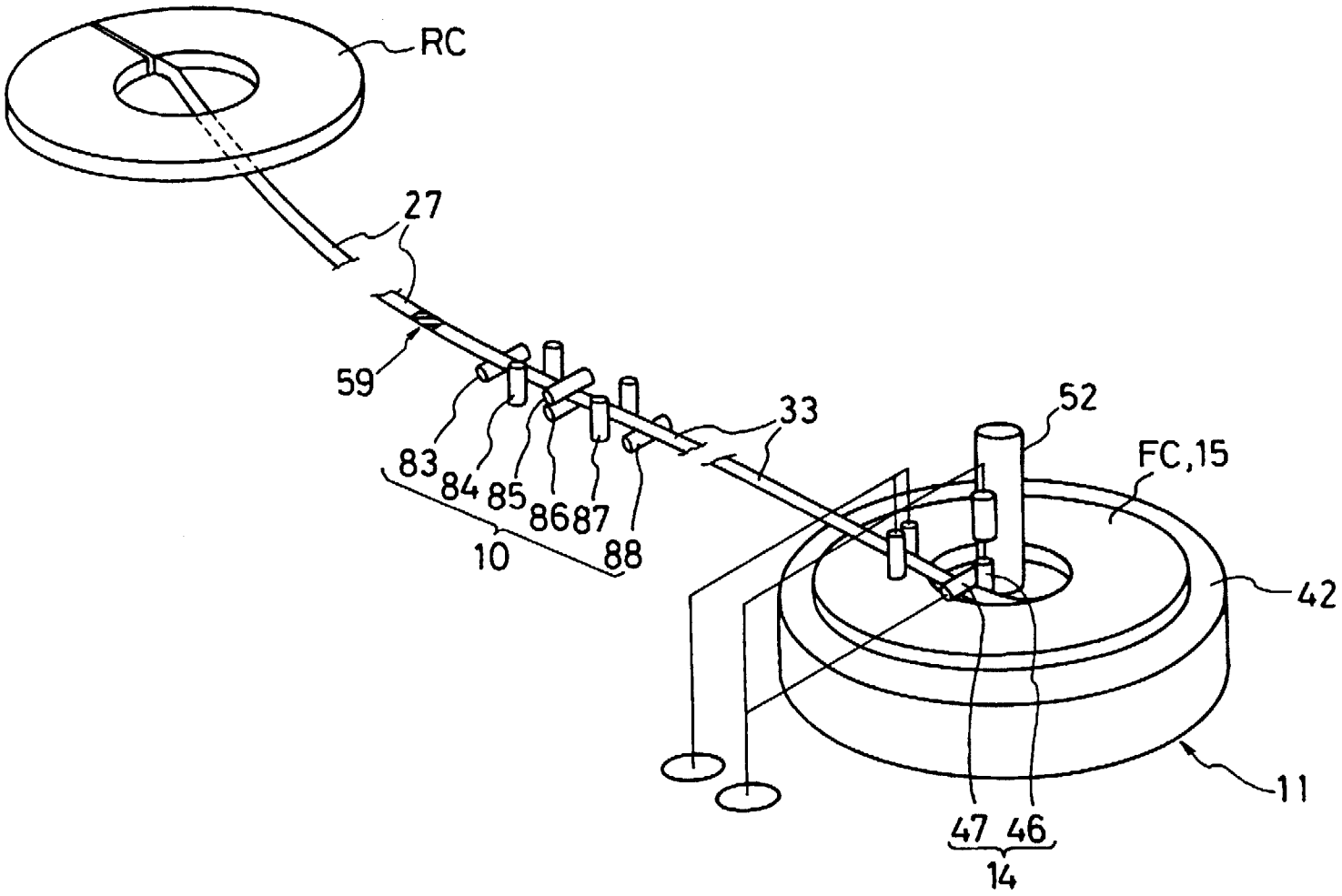
FIG. 26 is an oblique schematic view showing a positioning state of the coils placed in both forward and rear positions.

Regarding turn table device 11 (Refer to FIGS. 1, 24, 26)

In the turn table 11, the forward coil out of the coils, which are in the forward and rear positions in the coil transfer direction and connected to each other, is placed in the horizontal posture and in the rotatable state (Refer to FIG. 26). The forward coil FC is in a continued state with the rear coil RC as both strips thereof are welded, where 59 shows a welded part. The rear coil RC is vacuum sucked by the transfer equipment 1 and held in the horizontal posture and it is transferred so as to be stacked on the forward coil FC on the turn table device 11. Here, the number 15 in FIG. 26 shows stacked coils and the transfer equipment 1 is omitted.

A vertical positioning device 43, which lowers a table body 42 in correspondence with the upper plane position of the coil 15 which is stacked one by one and regulates the taking-up height of strips 27, 33 to a predetermined position, is provided in the turn table device 11 (Refer to FIG. 24). First, a supporting frame 92 is erected on a base frame 91, and a vertical driving motor 93, a ball thread 94 and a rail 95 in the Z direction are provided there. The ball thread 94 is rotatingly driven by the vertical driving motor 93 through a worm 96. A guide 97 which engages itself with the ball thread 94 is connected to a table frame 98, and this table frame 98 is so made as to be guided in the vertical direction with the rail 95. The vertical positioning device 43 is made with these constituent elements.

Further, a rotary driving device 44, which rotates the table body 42 for taking up the strips 27, 33 between the forward and rear coils FC, RC, is provided in the turn table device 11. That is, the table body 42 is built in the table frame 98, and another rotary driving motor 99 is provided in this table frame 98 and is connected to a ring gear 101 through a pinion 100. The ring gear 101 has an internal tooth provided therein and a pinion 100 is internally engaged therewith. The table body 42 is fixed on this ring gear 101. A rotary driving device 44 which rotates the table body 42 is made of these constituent elements.

The table body 42 has a central opening 102, and the tubular guide 52 is positioned there. This tubular guide 52 is provided on the forward end of a rod of the pressure cylinder 45 which is arranged on the base frame 91, and the entire guide 52 is made vertically movable and at the same time the plurality of split plane parts 103 which form a tubular plane can have their diameters expanded and shrunk by a pressure cylinder which is provided at the inside of the guide 52 but is not shown in the drawing. The tubular guide 52 performs a guide function, when its diameter is expanded, for determining the inserting positions for spacers S which are to be inserted between the coils 15 stacked in turn on the table body 42 (Refer to FIG. 18).

Regarding guide roll device 14 for taking-up guiding (Refer to FIGS. 21 to 23, FIG. 25)

The guide roll 14 for taking-up guiding is assembled to the turn table device 11. This guide roll 14 for taking-up guiding has a vertical roll 46 corresponding to side planes of the coils 15 and a horizontal roll 47 corresponding to upper edge planes of the coils 15, where both of the rolls 46, 47 can change their positions according to a revolute winding or involute winding of the coils 15 on the table body 42 and sizes of the strips 27, 33.

Figure 21:
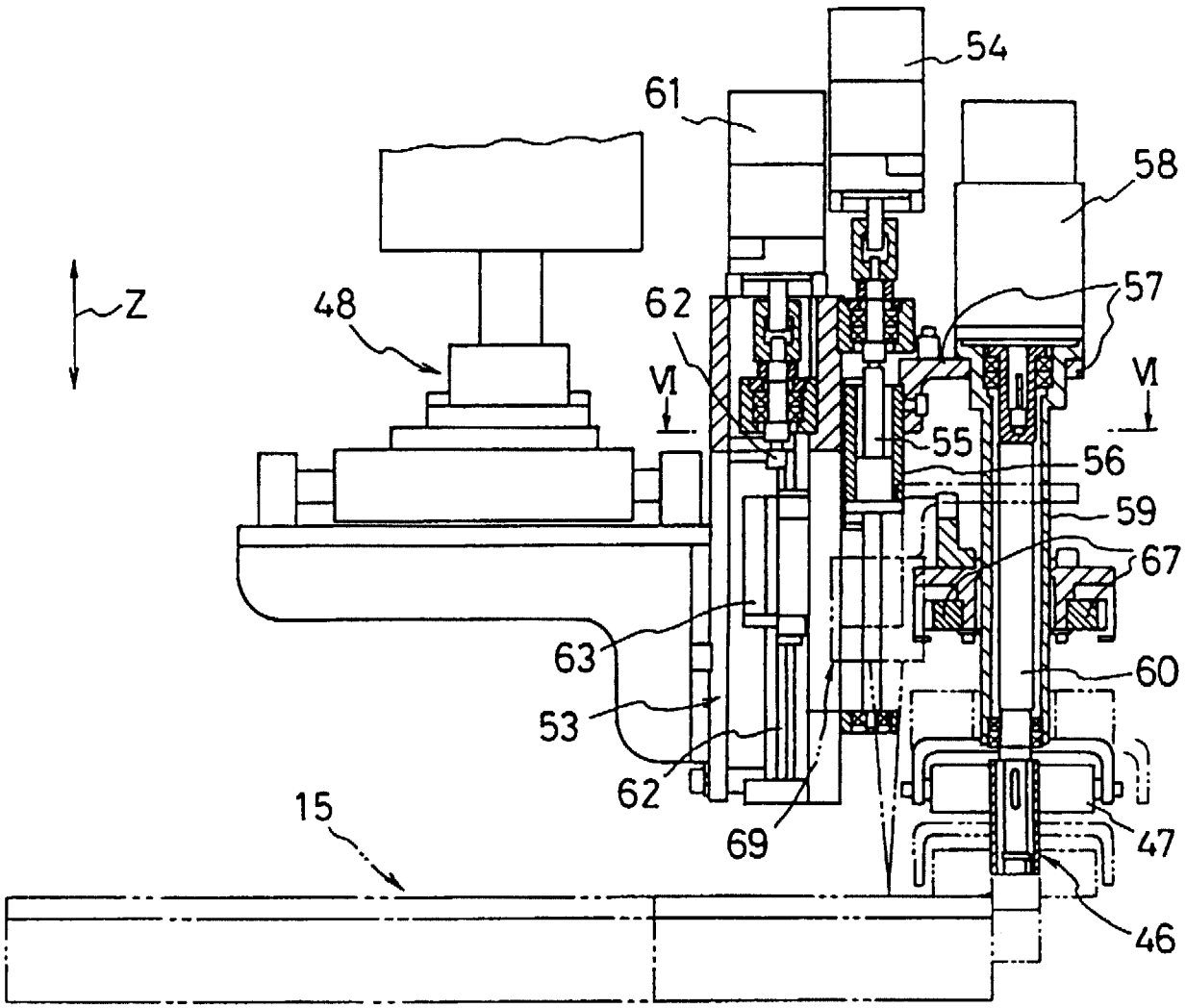
FIG. 21 is a cross sectional view of the important part of the guide roll device for taking-up guiding.
Figure 22:
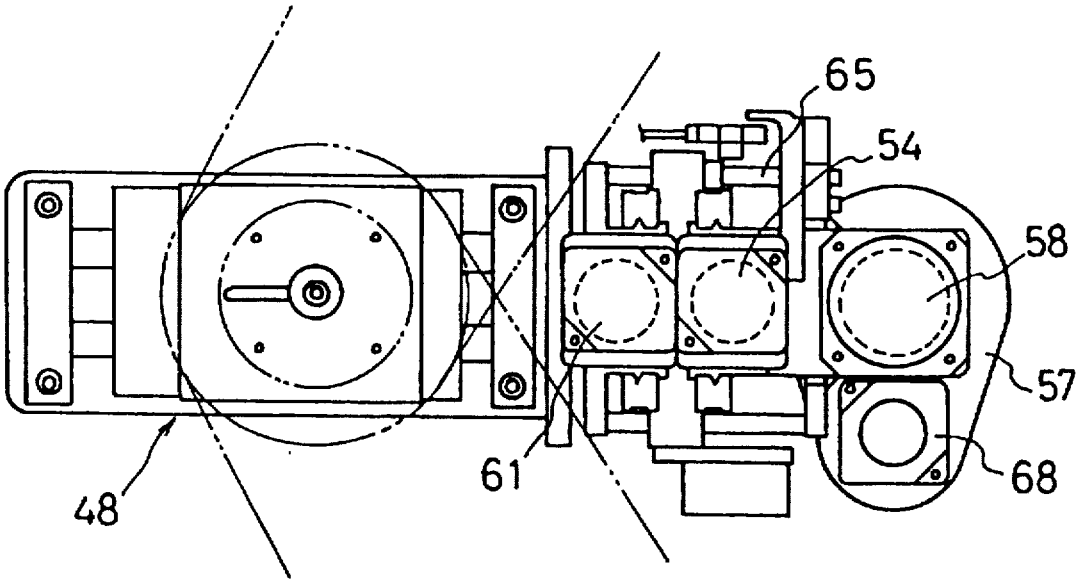
FIG. 22 is a plan view of the guide roll device for taking-up guiding shown in FIG. 21.

The vertical roll 46 and the horizontal roll 47 are mounted on the articulated robot hand 48 (Refer to FIG. 21 and FIG. 25). While a known type of articulated robot hand is used here, a certain device has been made on the way in which the vertical roll 46 and the horizontal guide 47 are mounted. First, a housing 53 is provided with the articulated robot hand 48, and a first vertical driving motor 54 is provided on the an outside of the housing 53. A first ball thread 55 which is connected to this first vertical driving motor 54 is provided in a hung down form, further a first guide part 56, which is made to engage with the first ball thread 55 and extends horizontally therefrom, is provided.

A rotary driving motor 58 is provided at the forward end of a first arm 57 which is made to protrude from the first guide part 56, then a rotating shaft 60 is provided within an tubular case 59 which is formed in such a manner that the case is hung down from the arm 57, where the upper part of the rotating shaft 60 is connected to the above mentioned rotary driving motor 58, further the vertical roll 46 is assembled to the lower part of the shaft 60. These elements constitute the "vertical driving system and rotary driving system for the vertical roll 46".

Next, explanations will be made on the "vertical driving system for and driving system for revolving the horizontal roll 47".

Figure 23:
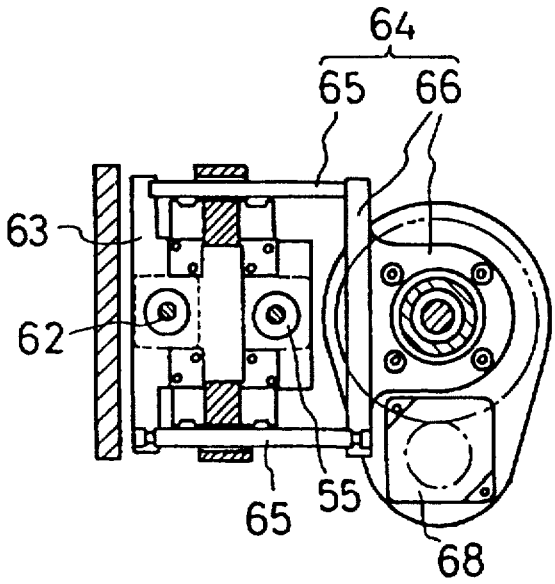
FIG. 23 is a lateral cross sectional view taken along arrow VI—VI in FIG. 21.

A second vertical driving motor 61 is assembled to the upper part of the above mentioned housing 53, and a second ball thread 62 which is connected to this second vertical driving motor 61 is provided within the housing 53 in such a manner that the ball thread 62 is hung down. A second guide part 63 engages with the second ball thread 62. And a second arm 64 protrudes from the second guide part 63. As shown in FIG. 23, a pair of arm parts 65 are made to protrude from the both sides of the second guide part 63 in such a manner that the arm parts do not interfere with the first ball thread 55 which contributes to the vertical driving of the vertical roll 46, and a second arm 64 is formed by joining both of the forward ends of the arm parts 65 with a forward end plate part 66 which has an L shaped cross section. Here, the forward end plate part 66 has the above mentioned tubular case 59 and the rotating shaft 60 penetrated therethrough at its central position.

The above mentioned tubular case 59 and a ring shaped gear 67 which is so arranged as to surround the rotating shaft 60 are provided below the forward end plate part 66 of the second arm 64, A driving motor 68 for revolving is provided at the position above the forward end plate part 66 which avoids the tubular case 59 and the rotating shaft 60. The gear 67 is made to revolve on the outside of the tubular case 59 and the rotating shaft 60 and the horizontal roll 47, which is supported in such a manner that the horizontal roll is hung down from the gear 67, is made to revolve around the vertical roll 46.

The operation of the articulated robot hand 48 and the operations of "vertical driving system and rotary driving system for the vertical roll 46" and "vertical driving system for and a driving system for revolving the horizontal roll 47" are made in a combined manner. When the coil 15 on the table body 42 of the turn table device 11 takes up the strips 27, 33 in the involute winding, the articulated robot hand 48 is so operated as to have the vertical roll 46 and the horizontal roll 47 correspond to the internal circumference of the coil 15 (Refer to FIG. 20A, FIG. 20B and FIG. 26), while the vertical roll 46 and the horizontal roll 47 are made to correspond to the external circumference of the coil 15 when the strips 27, 33 are taken up in the revolute winding (Refer to FIG. 19, FIG. 21).

As the coil 15 is rotatingly taken up, the articulated robot hand 48 works according to the inner and outer diameters of the coil 15 corresponding to an angle at which the strips 27, 33 are introduced to the coil 15 and to an extent of taking-up of the coil 15, to move the positions of the vertical roll 46 and the horizontal roll 47, and positioning angles of the vertical roll 46 and the horizontal roll 47 are made variable as required. And an adjustment is made by the above mentioned "driving system for revolving the horizontal roll 47" so that any desired angle, for instance an angle of 90 degree is maintained relative to a direction in which the strips 27, 33 are introduced.

Figure 19:
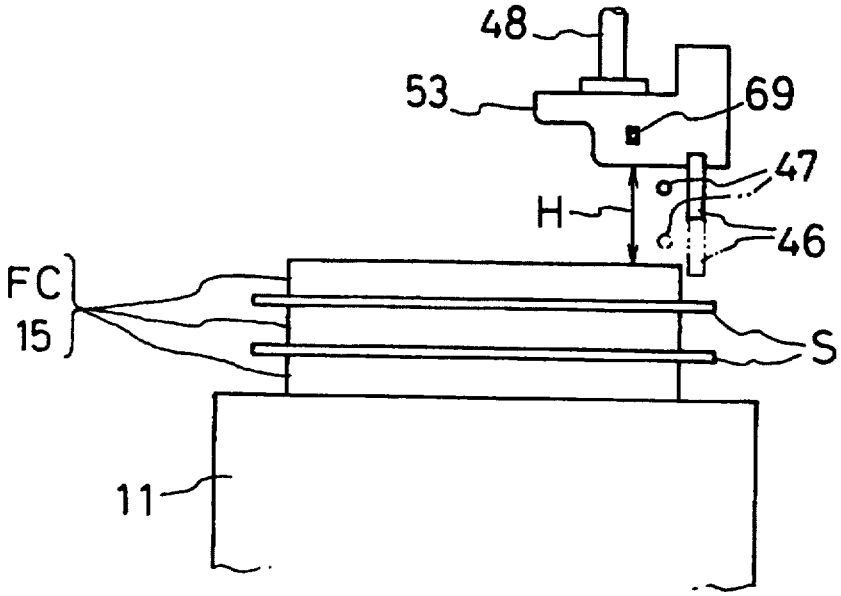
FIG. 19 is a schematic view showing a automatic follow-up function of a guide roll device for taking-up guiding.

A sensor 69 is provided in the guide roll device 14 for taking-up guiding (Refer to FIG. 19, FIG. 21). The sensor 69 is to detect the upper side planes of the coils so that the relationship between the positioning heights Ha, Hb of both the vertical and horizontal rolls 46, 47 and the height H of the upper side plane of the coil is retained to be constant, and "the vertical driving systems for both the vertical and horizontal rolls" are operated according to the measured values by this sensor 69 for having the vertical heights Ha, Hb of the both rolls 46, 47 follow-up the upper side plane of coil (Automatic follow-up function).

The function will be explained in a concrete manner. The heights Ha, Hb of the both vertical and horizontal rolls 46, 47 relative to the upper side plane of the coil are set by an input so that mainly, the Ha is set with widths of the strips 27, 33 used as the criterion for, and the Hb is set with width thickness (rigidity and others) of the strips 27, 33 used as the criterion. For example, for strips 27, 33 with a finished width of 9 mm, the Ha is set at 6 mm.

When the articulated robot hand 48 positions the vertical and horizontal rolls 46, 47 relative to the coil 15 (Refer to FIG. 19), both rolls 46, 47 will be still at their original points, then a distance H from the coil 15 is measured by the sensor 69. The heights, Ha, Hb of both rolls 46, 47 are to be determined relative to this measured distance H. Here, since the positional relationship between the sensor 69 and the position of the original point is known beforehand, such known value will be used as a correction value for the measured distance H.

Further, when the table body 42 on the turn table 11 rotates, it means that the coil 15, the object of measurement also rotates, therefore, the sensor 69 measures the distance H from the upper side plane of the coil 15 again only in such a case. An adjustment of the vertical position of both rolls 46, 47, that is an automatic follow-up will be done by the "vertical driving system" including respective vertical driving motors 54, 61.

If there is a tilt or warp generated in the coil 15 at this time, a vertical positional adjustment of both vertical and horizontal rolls 46, 47 relative to the coil 15 is done by the above mentioned automatic follow-up function, so that a risk for both rolls 46, 47 to interfere with the spacers S and others can be avoided.

Thus, the height Ha of the vertical roll 46 is adjusted for correspondence with the side plane of the coil 15, and the height Hb of the horizontal roll 47 is adjusted for correspondence with the upper edge plane of the coil 15. Such adjustments of the heights are made by the "vertical driving system for vertical roll 46" and "vertical driving system for horizontal roll 47".

Also, while the height of the upper plane of the coil becomes higher by the coils RC which are stacked on the table body 42, such increase in height is offset by lowering the table body 42 to always maintain a predetermined height. Therefore, the "vertical driving system for vertical roll 46" and the "vertical driving system for horizontal roll 47" do not have to contribute to the adjustment of the height of upper plane of coil.

Regarding auxiliary guide roll device 10 (Refer to FIG. 25, FIG. 26)

The auxiliary guide roll device 10 is assembled to the turn table device 11 in addition to the above mentioned guide roll device 14 for taking-up guiding. In this auxiliary guide roll device 10, a base frame 70 is arranged in the Y direction, and a pair of rails 71, a motor 72, a chain 73, a pair of sprockets 74, 75 are provided there, and a truck 76 connected to the chain 73 can advance and retract in the Y direction by a rotational driving of the motor 72.

A roll supporting part 78 with its height in the Z direction (up and down direction) made adjustable is provided in the truck 76, and a group of rolls are arranged there. The group of rolls are made of an entry side horizontal roll 83, a pair of vertical rolls 84 on the entry side, horizontal pinch rolls 85, 86 driven as a pair of up and down rolls, a pair of vertical rolls 87 on the exit side, and a horizontal roll 88 on the exit side, etc.

The horizontal pinch rolls 85, 86 jointly chuck the strips 27, 33. When the transfer equipment 1 makes such an approach as to go beyond the auxiliary guide roll device 10, the upper horizontal pinch roll 85 is opened to release the binding of the strips 27, 33 for placing them in a free state. On the other hand, the lower horizontal pinch roll 86 is connected to a motor not shown in the drawing. When the strips 27, 33 are chucked by its rotary driving force, the strips 27, 33 are conveyed from the entry side toward the exit side, and the strips 27, 33 are pushed into the coil FC on the turn table device 11.

Since the roll supporting part 78 can be adjusted vertically, the roll groups will have their positions determined to an appropriate guide height corresponding to an extent of the sag in the strips 27, 33 which are treated. The horizontal rolls 83, 88 and the vertical rolls 84, 87 at the entry side, the exit side restrain a twisting of the strips 27, 33 and adjust the form of these strips, and at the same time bear the weight and other load of lengthy strips 27, 33 in a joint action with the horizontal pinch rolls 85, 86, so that the load of the strips 27, 33 will not be borne by the coil FC on the turn table 11.

When the transfer equipment 1 approaches soon, the chucking state of the strips 27, 33 is released as mentioned above, and the entire device 10 together with the truck 76 moves in the Y direction and its position is so adjusted as not to interfere with the movement of the transfer equipment 1, that is, the movement of the strips 27, 33. At this point, the taking-up of the coil FC on the turn table 11 has been almost completed, and only a very short portion of the strips 27, 33 between both coils FC, RC remains uncoiled, thus the taking-up action can be continued without placing a load on the coil FC by the taking-up action of the turn table device 11 and the retention of the rear coil RC by the transfer equipment 1.

Figure 20A:
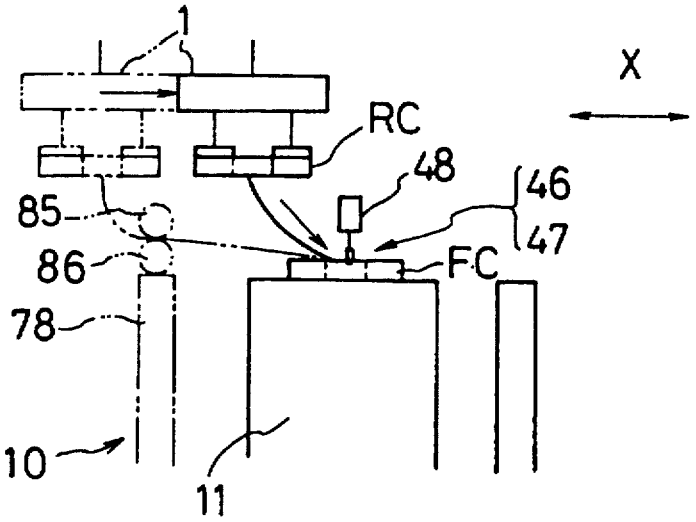
FIGS. 20 (A), 20 (B), and 20 (C) are process explanatory views showing the transfer taking-up and stacking of the coils.
Figure 20B:
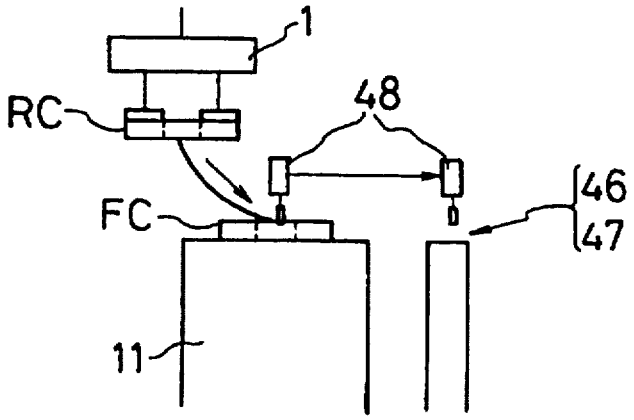
Figure 20C:
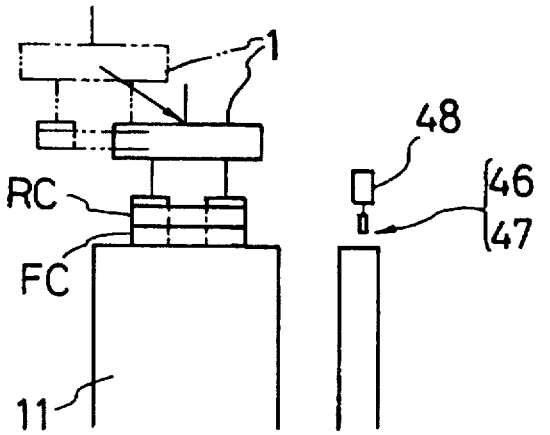

As the working state of each equipment explained above is consolidatedly explained by referring to FIGS. 20A to 20C, the transfer equipment 1 moves the rear coil RC, which is in a continuous form after the welding, in the transfer direction, while maintaining its horizontal posture. During these period of time, the auxiliary guide roll device 10 adjusts the form of the strips 27, 33 and at the same time chucks the same, and pushes them into the turn table device 11 while bearing the load of these strips 27, 33 which is stretched long. Also, the turn table device 11 takes up the strips 27, 33 by the rotation of the forward coil FC, further, at this time the guide roll device 14 for taking-up guiding adjusts the taking-up state in shape. During these period of time the follow-up function by the sensor 69 works, and both the vertical and horizontal rolls 46, 47 guide the strips 27, 33 in a safe state and help the coil FC, 15 to take up the strips 27, 33 in a desirable form.

When the transfer equipment 1 approaches the auxiliary guide device 10 to such a level as to go beyond the device 10 (FIG. 20A), the chucking state of the strips 27, 33 is released and at the same time the auxiliary guide roll device 10 moves to a position not interfering with the transfer equipment 1 (FIG. 20B). And the guide roll device 14 for taking-up guiding is made to come out of the position above the coil FC, 15 and is moved to its first stand-by position (right side position in FIG. 20B, imaginary line position in FIG. 25) by the articulated robot hand 48. And when the transfer equipment 1 comes further to a position above the turn table device 11, the rear coil RC which has been retained in the horizontal posture by the action of the transfer equipment 1 is lowered and is stacked over the forward coil FC, 15 (FIG. 20C), and after the stacking of the coil RC the table body 42 descends thus adjusting the height, thus preparing the table device 11 for transfer, taking-up and stacking of the next coil.

As has been explained, in a coil taking-up and stacking equipment according to the present invention, when coils are consecutively welded and formed into a continuous form of the coil and are taken up and stacked, the forward and rear coils are dividedly supported with the transfer equipment and the turntable device. The invention has such a remarkable effect that the turn table device can take up the strips while adjusting them in shape by an action of the guide roll device for taking-up guiding, and even when a tilt or warp is generated in the coil, the guide roll device for taking-up guiding can take a position which is safe to that coil by the follow-up function, thus avoiding any damage to the guide roll device.

We claim:

1. A method of joining a plurality of coils of strip material into a continuous strip and stacking the coils in a multi-coil arrangement, comprising the steps of:

(A) carrying a plurality of individual, independent coils stacked on their sides to a carry-in table;

(B) conveying a first coil from the carry-in table to an exit side turn table using a transfer means and designating the first coil as a forward coil;

(C) pulling a first strip of material from the forward coil and supplying the first strip to a welding machine through an auxiliary guide roll and an exit side guide roll;

(D) conveying a second coil from the carry-in table to an inverting table to change the winding direction of the second coil as required, and then conveying the second coil to an entry side turn table using the transfer means and designating the second coil as a rear coil;

(E) pulling a second strip of material from the rear coil and supplying the second strip of material to the welding machine through an entry side guide roll;

(F) welding the first and second strips of material together with the welding machine to form the first and second strips into a continuous strip of material;

(G) moving the rear coil from the entry side turn table using the transfer means and placing the rear coil in a stand-by position;

(H) removing sag from the continuous strip of material by synchronously rotating the entry side guide roll, the exit side guide roll, the auxiliary guide roll and the exit side turn table to remove a first sag in the continuous strip between the rear coil and the entry side guide roll and a second sag in the continuous strip between the entry side guide roll and the exit side guide roll by taking up and recoiling the continuous strip of material between the rear coil and the forward coil into the forward coil;

(I) conveying the rear coil toward the exit side turn table using the transfer means and simultaneously taking up and recoiling the continuous strip of material between the rear coil and the forward coil into the forward coil, and retracting the entry side guide roll, the exit side guide roll and the auxiliary guide roll from a path of the transfer means as the transfer means conveys the rear coil toward the forward coil;

(J) stopping said transfer means at a position corresponding to the exit side turn table to stack the rear coil over the forward coil in an uppermost position on the exit side turn table;

(K) designating the coil stacked in the uppermost position on the exit side turn table as the forward coil;

(L) conveying a third coil from the carry-in table to the entry side turn table using the transfer means, the third coil now being designated as the rear coil and being placed in a stand-by state: and (M) repeating the steps of pulling first and second strips of material from the forward and rear coils, welding the first and second strips of material together to form a continuous strip of material, removing sag from the continuous strip of material, moving the rear coil toward the forward coil and stacking the rear coil on the forward coil.

2. The method of claim 1 further comprising the steps of:

removing said plurality of coils which have been stacked on the exit side turn table as a single unit.

3. The method of claim 1, further comprising the steps of:

designating the coil stacked in the uppermost position on the exit side turn table as the forward coil;

conveying a third coil from the carry-in table to the entry side turn table using the transfer means, the third coil now being designated as a rear coil and being placed in a stand-by state; and repeating the steps of pulling first and second strips of material from the forward and rear coils, welding the first and second strips of material together to form a continuous strip of material, removing sag from the continuous strip of material, moving the rear coil toward the forward coil, and stacking the rear coil on the forward coil.

4. The method of claim 3 further comprising the steps of:

removing said plurality of coils which have been stacked on the exit side turn table as a single unit.

5. The method of claim 1 further comprising the steps of:

removing said plurality of coils which have been stacked on the exit side turn table as a single unit.

6. A method of joining a plurality of coils of strip material into a continuous strip and stacking the coils in a multi-coil arrangement, comprising the steps of:

carrying a plurality of individual, independent coils stacked on their sides to a carry-in table;

conveying a first coil from the carry-in table to an exit side turn table using a transfer means with a plurality of vacuum pads for vacuum suction attachment to the first coil for lifting the first coil and designating the first coil as a forward coil;

pulling a first strip of material from the forward coil and supplying the first strip to a welding machine through an auxiliary guide roll and an exit side guide roll;

conveying a second coil from the carry-in table to an entry side turn table using the transfer means and designating the second coil as a rear coil;

pulling a second strip of material from the rear coil and supplying the second strip of material to the welding machine through an entry side guide roll;

welding the first and second strips of material together with the welding machine to form the first and second strips into a continuous strip of material;

moving the rear coil from the entry side turn table using the transfer means and placing the rear coil in a stand-by position;

removing sag from the continuous strip of material by synchronously rotating the entry side guide roll, the exit side guide roll, the auxiliary guide roll and the exit side turn table to remove a first sag in the continuous strip between the rear coil and the entry side guide roll and a second sag in the continuous strip between the entry side guide roll and the exit side guide roll by taking up and recoiling the continuous strip of material between the rear coil and the forward coil into the forward coil;

conveying the rear coil toward the exit side turn table using the transfer means and simultaneously taking up and recoiling the continuous strip of material between the rear coil and the forward coil into the forward coil, and retracting the entry side guide roll, the exit side guide roll and the auxiliary guide roll from a path of the transfer means as the transfer means conveys the rear coil toward the forward coil; and stopping said transfer means at a position corresponding to the exit side turn table to stack the rear coil over the forward coil in an uppermost position on the exit side turn table.

* * * * *